US009127409B2

(12) United States Patent
Ueda et al.

(10) Patent No.: US 9,127,409 B2
(45) Date of Patent: Sep. 8, 2015

(54) RAIL

(71) Applicant: NIPPON STEEL & SUMITOMO METAL CORPORATION, Tokyo (JP)

(72) Inventors: Masaharu Ueda, Tokyo (JP); Teruhisa Miyazaki, Tokyo (JP); Takeshi Yamamoto, Tokyo (JP); Takashi Morohoshi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/382,693

(22) PCT Filed: Apr. 23, 2013

(86) PCT No.: PCT/JP2013/061857
§ 371 (c)(1),
(2) Date: Sep. 3, 2014

(87) PCT Pub. No.: WO2013/161794
PCT Pub. Date: Oct. 31, 2013

(65) Prior Publication Data

US 2015/0069141 A1 Mar. 12, 2015

(30) Foreign Application Priority Data

Apr. 23, 2012 (JP) ..... 2012-097584

(51) Int. Cl.
*E01B 5/02* (2006.01)
*C21D 9/04* (2006.01)
(Continued)

(52) U.S. Cl.
CPC ... *E01B 5/02* (2013.01); *C21C 7/06* (2013.01); *C21D 9/04* (2013.01); *C22C 38/00* (2013.01);
(Continued)

(58) Field of Classification Search
CPC ..... C22C 38/02; C22C 38/04; C22C 38/06; C22C 38/12; C22C 38/08; C22C 38/34; C22C 38/38; C22C 38/58; B21B 1/085; C21D 9/04; E01B 5/02
USPC ..... 238/150; 148/320, 584; 420/103, 104, 420/120, 99
See application file for complete search history.

(56) References Cited

U.S. PATENT DOCUMENTS 5,209,792 A * 5/1993 Besch et al. ..... 148/581
5,382,307 A * 1/1995 Kageyama et al. ..... 148/584
(Continued)

FOREIGN PATENT DOCUMENTS

CN 102137947 A 7/2011
CN 102301023 A 12/2011
(Continued)

OTHER PUBLICATIONS

International Search Report, issued in PCT/JP2013/061857, dated Jul. 30, 2013.
(Continued)

*Primary Examiner* — Mark Le
(74) *Attorney, Agent, or Firm* — Birch, Stewart, Kolasch & Birch, LLP

(57) ABSTRACT

In the rail, 95% or more of a structure in a head surface section, which is a range from surfaces of head corner sections and a head top section of the rail as a starting point to a depth of 20 mm, is a pearlite or bainite structure and the structure contains 20 to 200 MnS-based sulfides formed around an Al-based oxide as a nucleus and having a grain size in a range of 1 μm to 10 μm per square millimeter of an area to be inspected on a horizontal cross section of the rail.

6 Claims, 6 Drawing Sheets

(51) Int. Cl.

| | |
|---|---|
| ***C21C 7/06*** | (2006.01) |
| ***C22C 38/06*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/18*** | (2006.01) |
| ***C22C 38/22*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/12* (2013.01); *C22C 38/18* (2013.01); *C22C 38/22* (2013.01); *C22C 38/58* (2013.01); *C21D 2211/002* (2013.01); *C21D 2211/004* (2013.01); *C21D 2211/009* (2013.01)

(56) References Cited

U.S. PATENT DOCUMENTS

| | | | | |
|---|---|---|---|---|
| 5,645,653 | A * | 7/1997 | Jerath et al. | 148/320 |
| 5,759,299 | A | 6/1998 | Yokoyama et al. | |
| 7,288,159 | B2 * | 10/2007 | Cordova | 148/584 |
| 7,374,622 | B2 * | 5/2008 | Zboril et al. | 148/335 |
| 2006/0137768 | A1 * | 6/2006 | Yuse et al. | 148/320 |
| 2007/0006948 | A1 * | 1/2007 | Nonaka et al. | 148/603 |
| 2010/0186857 | A1 * | 7/2010 | Honjo et al. | 148/584 |
| 2011/0155821 | A1 | 6/2011 | Ueda et al. | |
| 2011/0226389 | A1 * | 9/2011 | Ueda et al. | 148/330 |
| 2011/0303756 | A1 | 12/2011 | Ueda et al. | |
| 2012/0298262 | A1 * | 11/2012 | Hirakami et al. | 148/230 |

FOREIGN PATENT DOCUMENTS

| | | | |
|---|---|---|---|
| JP | 7-305144 | A | 11/1995 |
| JP | 8-92645 | A | 4/1996 |
| JP | 8-92696 | A | 4/1996 |
| JP | 8-104946 | A | 4/1996 |
| JP | 8-144016 | A | 6/1996 |
| JP | 8-158014 | A | 6/1996 |
| JP | 8-246100 | A | 9/1996 |
| JP | 9-111352 | A | 4/1997 |
| JP | 9-296254 | A | 11/1997 |
| JP | 2002-69585 | A | 3/2002 |
| JP | 2002-363697 | A | 12/2002 |
| JP | 2002-363698 | A | 12/2002 |
| JP | 2002-363702 | A | 12/2002 |
| JP | 2003-105499 | A | 4/2003 |
| JP | 2007-277716 | A | 10/2007 |
| JP | 2008-50684 | A | 3/2008 |
| RU | 94040705 | A1 | 6/1996 |
| RU | 2 122 056 | C1 | 11/1998 |
| RU | 2 136 767 | C1 | 9/1999 |
| RU | 2 139 946 | C1 | 10/1999 |

OTHER PUBLICATIONS

Written Opinion of the International Search Authority, issued in PCT/JP2013/061857, dated Jul. 30, 2013.

Decision to Grant dated Apr. 28, 2015, issued in Russian Patent Application No. 2014137250.

Chinese Office Action dated Jul. 3, 2015 issued in Chinese Patent Application No. 201380014623.8, with English language translation.

* cited by examiner

RAIL

TECHNICAL FIELD OF THE INVENTION

The present invention relates to a high-strength rail used for freight railways having improved delayed fracture resistance.

Priority is claimed on Japanese Patent Application No. 2012-097584, filed on Apr. 23, 2012, and the contents of which are incorporated herein by reference.

RELATED ART

In accordance with economic development, efforts are being made to newly exploit natural resources such as coal. Specifically, mining in a district with harsh natural environments that has been thus far left unexploited is underway. Accordingly, in freight railways that transport resources, the track environment is becoming significantly harsher. As a result, there has been a demand for better than ever wear resistance for rails. From the above-described background, there has been a demand for the development of a rail having better wear resistance than high-strength rails currently in use.

Rails described below have been developed to improve the wear resistance or surface damage resistance of rails. A principal property of the above-described rails is that, to improve the wear resistance, by increasing the amount of carbon in steel, the volume fraction of cementite in a pearlite lamellar is increased and the strength is increased (for example, refer to Patent Documents 1 and 2). Alternatively, to improve the surface damage resistance as well as the wear resistance, the metallographic structure is consists of bainite, and the strength is increased (for example, refer to Patent Document 3).

Patent Document 1 discloses a rail having excellent wear resistance in which the volume fraction of cementite in a lamellar in a pearlite structure is increased using hyper-eutectoid steel (C: more than 0.85% to 1.20%).

Patent Document 2 discloses a rail having excellent wear resistance in which the volume fraction of cementite in a lamellar in a pearlite structure is increased using hyper-eutectoid steel (C: more than 0.85% to 1.20%), and similarly, the hardness is controlled.

Patent Document 3 discloses a rail having improved wear resistance and surface damage resistance in which the amount of carbon is set in a range of 0.2% to 0.5%, and Mn and Cr are added so as to form the metallographic structure with bainite and to improve the strength.

In the techniques disclosed in Patent Documents 1 to 3, the volume fraction of cementite in the pearlite structure is increased, and simultaneously, the strength is increased. Alternatively, the metallographic structure is formed with bainite so as to further increase the strength. Therefore, the wear resistance can be improved. However, when the strength was increased, the risk of the occurrence of delayed fracture due to residual hydrogen in steel heightened, and there was a problem in that rail breakage became likely to occur.

Therefore, there has been a demand for the development of a high-strength rail suppressing the occurrence of delayed fracture caused by residual hydrogen. To solve the above-described problem, high-strength rails described below have been developed. In these rails, hydrogen accumulation places are dispersed by increasing hydrogen trapping sites in steel.

In addition, in the rails, delayed fracture is suppressed by refining the structure or by suppressing the precipitation of carbides in grain boundaries (for example, refer to Patent Documents 4 to 6).

Patent Documents 4 and 5 disclose rails in which the delayed fracture resistance is improved by dispersing A-based inclusions (for example, MnS) or C-based inclusions (for example, $SiO_2$ or CaO) defined as JIS G 0202 that are hydrogen trap sites in a pearlite structure, and furthermore by controlling the amount of hydrogen in steel.

Patent Document 6 discloses a rail having excellent delayed fracture resistance in which Nb is added so as to refine the bainite structure and to prevent the precipitation of carbides in grain boundaries.

However, in the techniques disclosed in Patent Documents 4 and 5, the inclusions that are the trap sites of residual hydrogen are coarsened depending on the component system, and the delayed fracture resistance of pearlite steel does not sufficiently improve. Additionally, there is a problem in that the inclusions serve as initiation points of fatigue or fracture depending on the types of the inclusions, and rail breakage becomes likely to occur. In addition, in the technique disclosed in Patent Document 6, there are problems in that the structure is not sufficiently refined or the precipitation of carbides in grain boundaries is not sufficiently suppressed due to the addition of an alloy, the effects are not stable, and the cost increases due to the addition of an alloy.

Patent Document 7 discloses a pearlite-based rail in which, toughness and ductility are improved using Mg oxide, Mg—Al oxide, Mg sulfide or an inclusion in which MnS is precipitated from the above-described oxide or sulfide as a nucleus, in order to improve the fatigue damage resistance.

However, in the technique disclosed in Patent Document 7, it is necessary to add 0.0004% or more of Mg to the pearlite-based rail. Mg is an element having a high vapor pressure and having a poor yield even when being added to molten steel. Therefore, in the technique disclosed in Patent Document 7, control for sufficiently obtaining Mg oxide, Mg—Al oxide or Mg sulfide is difficult, and there is a problem in that the cost increases.

PRIOR ART DOCUMENT

Patent Document

[Patent Document 1] Japanese Unexamined Patent Application, First Publication No. H08-144016

[Patent Document 2] Japanese Unexamined Patent Application, First Publication No. H08-246100

[Patent Document 3] Japanese Unexamined Patent Application, First Publication No. H09-296254

[Patent Document 4] Japanese Unexamined Patent Application, First Publication No. 2007-277716

[Patent Document 5] Japanese Unexamined Patent Application, First Publication No. 2008-50684

[Patent Document 6] Japanese Unexamined Patent Application, First Publication No. H08-158014

[Patent Document 7] Japanese Unexamined Patent Application, First Publication No. 2003-105499

[Patent Document 8] Japanese Unexamined Patent Application, First Publication No. H08-246100

[Patent Document 9] Japanese Unexamined Patent Application, First Publication No. H09-111352

[Patent Document 10] Japanese Unexamined Patent Application, First Publication No. H08-092645

DISCLOSURE OF THE INVENTION

Problems to be Solved by the Invention

The present invention has been made in consideration of the above-described problems. An object of the present invention is to provide a rail having improved delayed fracture resistance required particularly for rails in freight railways that transport resources.

Means for Solving the Problem (1) According to an aspect of the present invention, there is provided a rail including, by mass %, C: 0.70% to 1.20%, Si: 0.05% to 2.00%, Mn: 0.10% to 2.00%, P: 0.0200% or less, S: more than 0.0100% to 0.0250%, Al: 0.0020% to 0.0100%, and a balance consisting of Fe and impurities, in which a 95% or more of a structure in a head surface section, which is a range from surfaces of head corner sections and a head top section of the rail as a starting point to a depth of 20 mm, is a pearlite or bainite structure; and the structure contains 20 to 200 MnS-based sulfides formed around an Al-based oxide as a nucleus and having a grain size in a range of 1 μm to 10 μm per square millimeter of an area to be inspected on a horizontal cross section of the rail.

(2) In the rail according to the above (1), an S content may be in a range of 0.0130% to 0.0200% by mass %.

(3) In the rail according to the above (1) or (2), an H content may be 2.0 ppm or less.

(4) In addition, the rail according to any one of the above (1) to (3) may further include, by mass %, one or more of Ca: 0.0005% to 0.0200%, REM: 0.0005% to 0.0500%, Cr: 0.01% to 2.00%, Mo: 0.01% to 0.50%, Co: 0.01% to 1.00%, B: 0.0001% to 0.0050%, Cu: 0.01% to 1.00%, Ni: 0.01% to 1.00%, V: 0.005% to 0.50%, Nb: 0.001% to 0.050%, Ti: 0.0050% to 0.0500%, Zr: 0.0001% to 0.0200% and N: 0.0060% to 0.0200%.

Effects of the Invention

According to the aspect of the present invention, it is possible to improve the delayed fracture resistance of a rail used for freight railways that transport resources and to significantly improve the service life by controlling the components and structure of the rail, and furthermore, by controlling the form or number of MnS-based sulfides formed around an Al-based oxide in steel as a nucleus.

EMBODIMENTS OF THE INVENTION

Figure 1:
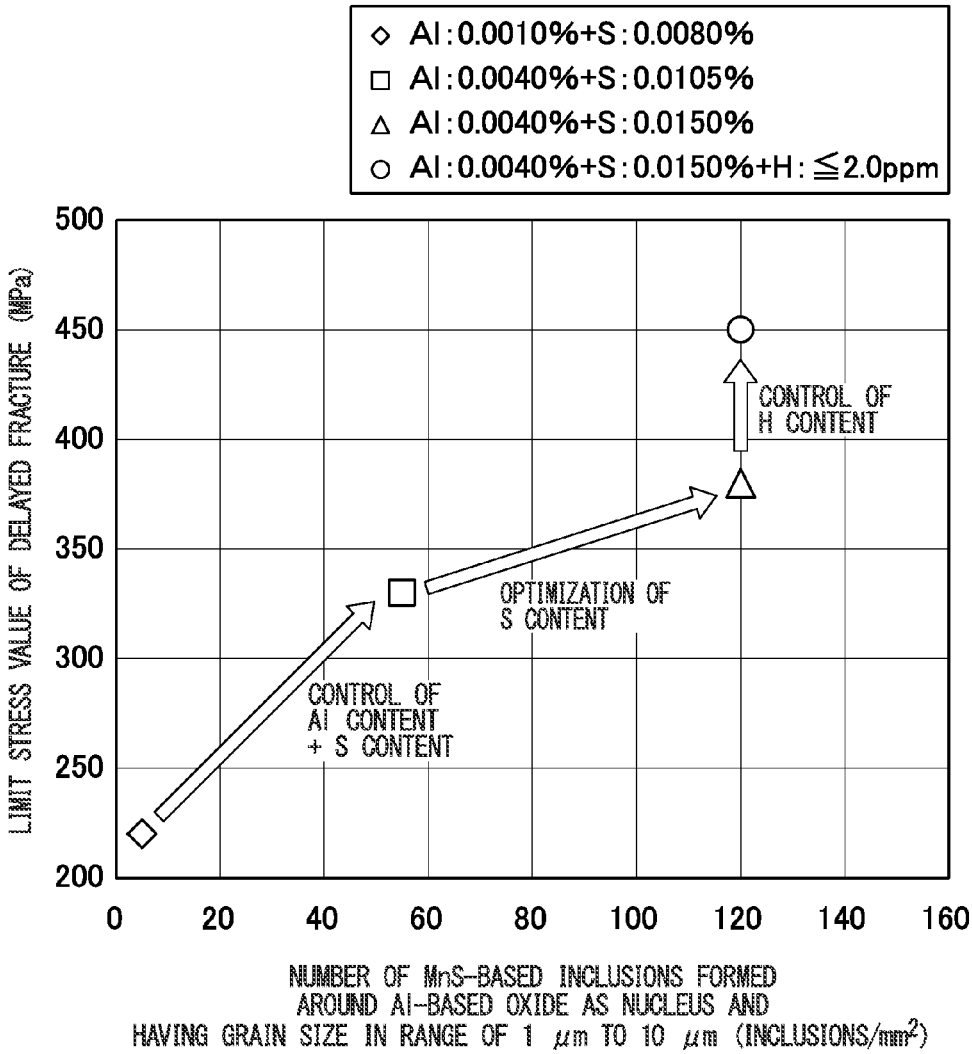
FIG. 1 is a view illustrating a relationship between the number of fine (grain size in a range of 1 μm to 10 μm) MnS-based sulfides formed around an Al-based oxide in steel as a nucleus and the threshold stress value of delayed fracture.

Hereinafter, an embodiment of the present invention will be described in detail using the accompanying drawings. However, the present invention is not limited to the below description, and a person skilled in the art can easily understand that the form and detail of the present invention can be modified in various manners within the purport and scope of the present invention. Therefore, the interpretation of the present invention is not limited to the descriptions of the embodiment described below.

As the embodiment, a rail having excellent delayed fracture resistance (hereinafter, sometimes, referred to as a rail according to the embodiment) will be described in detail. Hereinafter, the unit of a composition, mass %, will be simply expressed as %.

First, the present inventors studied a method of improving the delayed fracture resistance of a rail (steel rail) using inclusions that are hydrogen trap sites. As a result of studying the cheap inclusions having a small effect on the various properties of the rail, it was clarified that a soft MnS-based sulfide (sulfide containing 80% or more of MnS) formed from S contained as an impurity of iron and Mn generally added as a strengthening element has no effect on toughness or fatigue properties and is cheap, and therefore the MnS-based sulfides are promising hydrogen trap sites.

Next, to use MnS-based sulfides as the hydrogen trap sites, the formation state of the MnS-based sulfides in a rail of the related art was investigated. As a result, it was found that the MnS-based sulfides are classified into relatively large MnS-based sulfides and relative small MnS-based sulfides having a grain size of 5 μm or less.

To make the MnS-based sulfides effectively serve as the hydrogen trap sites, it is necessary to increase the surface area between the MnS-based sulfides that are the trap sites and base metal in contact with the MnS-based sulfide, that is, to refine the MnS-based sulfides.

Therefore, first, the forming behaviors of the large MnS-based sulfides were investigated. As a result of analyzing steel in the middle of solidification, it became clear that the MnS-based sulfides are formed from a liquid phase in most steel and coarsen in the liquid phase before the steel is solidified (gamma iron).

The inventors studied a method for refining the MnS-based sulfides formed in the liquid phase. As a result, it was found that, to refine the MnS-based sulfides, stable nuclei accelerating the formation of the MnS-based sulfides in the liquid phase are required. Based on the above-described finding, an attention was paid to an oxide that is stable at a high temperature, and fine oxides were selected to use the oxides as the nuclei. Steel containing 1.0% of carbon was melted, and a variety of oxide-forming elements were added, thereby investigating the forming behaviors of oxides and MnS-based sulfides. As a result, it was found that, when a certain amount of Al is added, and an Al-based oxide is finely dispersed in a liquid phase, it is possible to make the Al-based oxide having a close lattice constant to the lattice constant of MnS serve as a formation nucleus of the MnS-based sulfides, and consequently, it is possible to refine the MnS-based sulfides.

Next, the inventors studied the Al content for finely forming the Al-based oxide in a liquid phase. As a result, it was found that, to prevent the formation of a coarse Al-based oxide having an adverse effect on the various properties of the rail and to form a sufficient amount of a fine Al-based oxide in a liquid phase, it is important to control the Al content to be in a certain range.

On the basis of the above-described finding, the inventors investigated the delayed fracture resistance as described below. That is, first, steel containing 0.0010% of Al and 0.0080% of S and steel containing 0.0040% of Al and 0.0105% of S, both of which also contain 1.0% of carbon (0.2% Si-1.0% Mn) and 2.5 ppm of hydrogen as base components, were melted, and produced steel pieces. Next, rail rolling and a heat treatment were carried out on the steel pieces, thereby manufacturing rails having a pearlite or bainite structure in the head surface section (a range from the outer surface of the head section as the starting point to a depth of 20 mm). A three-point bend test in which tensile stress was applied to the head section was carried out on the rails obtained as described above, and the delayed fracture resistance was evaluated. The delayed fracture resistance was evaluated using a three-point bend (span length: 1.5 m) method so that the tensile stress acted on the head section. The stress condition was set in a range of 200 MPa to 500 MPa, the stress application time was set to 500 hours, and the maximum value of the stress in a case in which the steel piece was not broken when the stress had been applied over 500 hours was considered as the threshold stress value of delayed fracture.

As a result of the delayed fracture test, for the steel containing 0.0010% of Al that is the content in a case in which Al is intentionally not added during ordinary rail refining and 0.0080% of S that is the content in a rail obtained from ordinary rail refining, the threshold stress value of delayed fracture was 220 MPa. Meanwhile, for the steel containing 0.0040% of Al and 0.0105% of S, the threshold stress value of delayed fracture was 330 MPa. That is, it was found that, when the amounts of Al and S are increased, the number of fine MnS-based sulfides formed around an Al-based oxide as a nucleus increases, and the delayed fracture resistance improves.

Furthermore, the inventors studied a method for further improving the delayed fracture resistance. Steel containing 1.0% of carbon (0.2% Si-1.0% Mn-0.0040% Al) and 2.5 ppm of hydrogen as base components and having changed the S contents of 0.0105% and 0.0150%, respectively, were melted, and rail rolling and a heat treatment were carried out, thereby manufacturing rails having a pearlite or bainite structure in the head surface section. A three-point bend test in which tensile stress was applied to the head section was carried out using the rails, and the delayed fracture resistance was evaluated.

As a result, for the rail containing 0.0105% of S, the threshold stress value of delayed fracture was 330 MPa, and for the rail containing 0.0150% of S, the threshold stress value of delayed fracture was 380 MPa. That is, it was confirmed that, when the S content is increased, the number of fine MnS-based sulfides formed around an Al-based oxide that is a hydrogen trap site as a nucleus further increases, and the delayed fracture resistance improves.

In addition to the control of the MnS-based sulfide, the inventors studied a method of further improving the delayed fracture resistance. As a result, it was confirmed that, when the amount of hydrogen (H content) is controlled to 2.0 ppm or less by intensifying the secondary refining (degassing) of molten steel or applying a dehydrogenation treatment in a steel piece phase, the threshold stress value of delayed fracture improves up to 450 MPa, and the delayed fracture resistance further improves.

Figure 3:
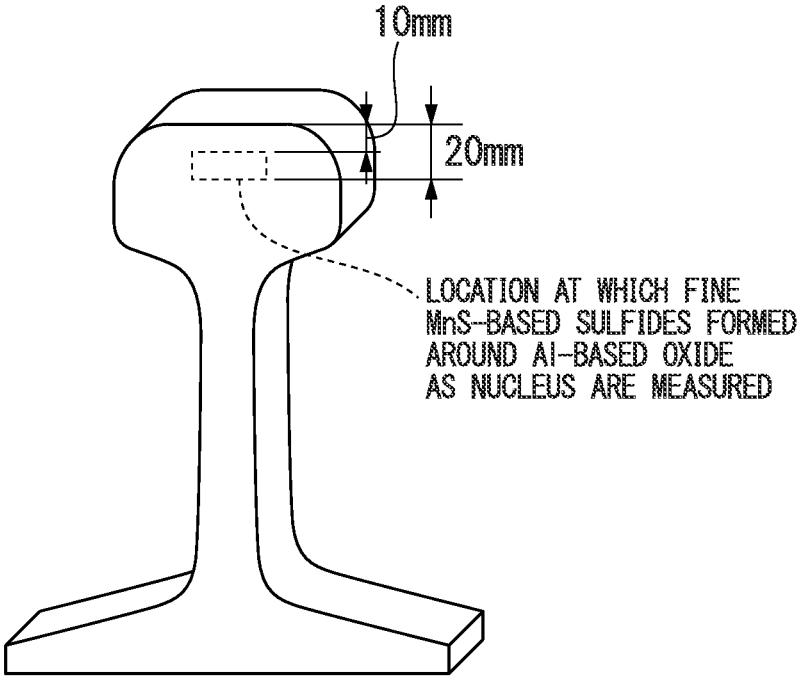
FIG. 3 is a view illustrating a location at which the fine (grain size in a range of 1 μm to 10 μm) MnS-based sulfides formed around an Al-based oxide as a nucleus are measured.

FIG. 1 illustrates a relationship between the number of fine (grain size in a range of 1 μm to 10 μm) MnS-based sulfides formed around an Al-based oxide in steel as a nucleus and the threshold stress value of delayed fracture. The number of fine MnS-based sulfides formed around an Al-based oxide as a nucleus was measured using an optical microscope or a scanning electron microscope after taking a sample at a location 10 mm to 20 mm deep from the surface of the rail head section and polishing the horizontal cross section. The number of fine MnS-based sulfides (grain size in a range of 1 μm to 10 μm) was converted to the number of the grains per square millimeter after the measurement. Meanwhile, the horizontal cross section refers to a cross section obtaining by cutting a rail in a direction perpendicular to the longitudinal direction as illustrated in FIG. 3 described below.

When the S content is controlled in a predetermined range, and then the Al content is increased, the number of fine MnS-based sulfides increases, and the threshold stress value increases as illustrated in FIG. 1. In addition, when the S content is further increased, the number of fine MnS-based sulfides further increases, and the threshold stress value increases. In addition, when the amount of hydrogen in steel is controlled to 2.0 ppm or less, the threshold stress value further improves.

That is, the rail according to the embodiment relates to a rail intended to improve the delayed fracture resistance of a rail used for freight railways and to significantly improve the service life by controlling the chemical components and the structure and controlling the form or number of MnS-based sulfides formed around an Al-based oxide in steel as a nucleus. Meanwhile, in the rail according to the embodiment, additionally, it is possible to further improve the delayed fracture resistance by increasing the S content and reducing the amount of hydrogen.

The reasons for limiting the steel composition of the rail according to the embodiment will be described. Hereinafter, the unit of the steel composition, mass %, will be simply expressed as %.

(1) the Reasons for Limiting the Chemical Components (Steel Composition) of Steel The reasons for limiting the chemical components of steel in the above-described numeric ranges in the rail according to the embodiment will be described in detail.

C: 0.70% to 1.20%

C is an effective element for accelerating pearlitic transformation in the structure in steel and ensuring the wear resistance of the rail. In addition, C is a necessary element for maintaining the strength of the bainite structure. When the C content is less than 0.70%, a soft pro-eutectoid ferrite structure in which strain is likely to be stored is formed, and delayed fracture becomes likely to occur. In addition, when the C content is less than 0.70%, in the component system of the rail according to the embodiment, it is not possible to maintain the minimum strength or wear resistance required for rails. On the other hand, when the C content exceeds 1.20%, a large amount of a pro-eutectoid cementite structure having low toughness is formed, and delayed fracture becomes likely to occur. Therefore, the C content is limited in a range of 0.70% to 1.20%. Meanwhile, to stabilize the formation of the pearlite structure or the bainite structure and improve the delayed fracture resistance, the lower limit of the C content is desirably set to 0.80%, and the upper limit of the C content is desirably set to 1.10%.

Si: 0.05% to 2.00%

Si is an element that forms a solid solution in ferrite in the pearlite structure or the base ferrite structure in the bainite structure, increases the hardness (strength) of the rail head section, and improves the wear resistance. Furthermore, Si is an element that suppresses the formation of a pro-eutectoid cementite structure having low toughness and suppresses the occurrence of delayed fracture in hyper-eutectoid steel. However, when the Si content is less than 0.05%, the above-described effects cannot be sufficiently expected. On the other hand, when the Si content exceeds 2.00%, the number of surface defects are generated during hot rolling. Furthermore, when the Si content exceeds 2.00%, the hardenability significantly increases, a martensite structure having low toughness is formed in the head surface section, and delayed fracture becomes likely to occur. Therefore, the Si content is limited in a range of 0.05% to 2.00%. Meanwhile, to stabilize the formation of the pearlite structure or the bainite structure and improve the delayed fracture resistance, the lower limit of the Si content is desirably set to 0.10%, and the upper limit of the Si content is desirably set to 1.50%.

Mn: 0.10% to 2.00%

Mn is an element that improves the hardenability, stabilizes the formation of pearlite, and simultaneously, decreases the lamellar spacing in the pearlite structure. Furthermore, Mn is an element that stabilizes the formation of bainite, simultaneously, decreases the transformation temperature, ensures the hardness of the pearlite structure or the bainite structure, and improves the wear resistance. However, when the Mn content is less than 0.10%, the effect is small. In addition, when the Mn content is less than 0.10%, the formation of a soft pro-eutectoid ferrite structure in which strain is likely to be stored is induced, and it becomes difficult to ensure the wear resistance or the delayed fracture resistance. On the other hand, when Mn content exceeds 2.00%, the hardenability significantly increases, a martensite structure having an adverse effect on toughness is formed in the head surface section, and delayed fracture becomes likely to occur. Therefore, the Mn content is limited to be in a range of 0.10% to 2.00%. Meanwhile, to stabilize the formation of the pearlite structure or the bainite structure and improve the delayed fracture resistance, the lower limit of the Mn content is desirably set to 0.20%, and the upper limit of the Mn content is desirably set to 1.50%.

P: 0.0200% or less

P is an element inevitably contained in steel. Generally, when refining is carried out in a converter, the P content is controlled in a range of 0.0020% to 0.0300%. However, when the P content exceeds 0.0200%, the toughness of the pearlite structure decreases, and delayed fracture becomes easy to occur. Therefore, in the embodiment, the P content is limited to 0.0200% or less. When the P content is decreased, the toughness of the pearlite structure is improved, and delayed fracture can be suppressed. Since the P content is desirably smaller, the lower limit of the P content is not specified. However, even when the P content is decreased to less than 0.0030%, there is no additional improvement of delayed fracture resistance. Furthermore, refining costs increase, and economic efficiency decreases. Therefore, the lower limit of the P content is desirably set to 0.0030%. To suppress the decrease in the toughness of the pearlite structure and sufficiently suppress delayed fracture, the lower limit of the P content is desirably set to 0.0050%, and the upper limit of the P content is desirably set to 0.0150% in consideration of economic efficiency.

S: more than 0.0100% to 0.0250%

S is an element inevitably contained in steel. Generally, when refining is carried out in a converter, the S content is reduced up to 0.0030% to 0.0300%. However, there is a correlation between the S content and the formation amount of the MnS-based sulfide, and, when the S content increases, the number of fine MnS-based sulfides formed around an Al-based oxide as a nucleus increases, and therefore, in the rail according to the embodiment, the S content is set to more than 0.0100%. When the S content is 0.0100% or less, an increase in the formation amount of a fine MnS-based sulfide cannot be expected. On the other hand, when the S content exceeds 0.0250%, stress concentration or structure embrittlement occurs due to the coarsening of the MnS-based sulfide or an increase in the formation density, and rail breakage becomes likely to occur. Therefore, the S content has been limited in a range of more than 0.0100% to 0.0250%. Meanwhile, to further accelerate the formation of a fine MnS-based sulfide and prevent the coarsening of the MnS-based sulfide, the lower limit of the S content is desirably set to 0.0130%, and the upper limit of the S content is desirably set to 0.0200% or less.

Al: 0.0020% to 0.0100%

Al acts as a formation nucleus of a MnS-based sulfide in a liquid phase, and is an essential element for finely dispersing the MnS-based sulfide. When the Al content is less than 0.0020%, the amount of an Al-based oxide formed is small, and Al does not sufficiently act as a formation nucleus of a MnS-based sulfide in a liquid phase. Therefore, it becomes difficult to finely disperse the MnS-based sulfide specified in the embodiment. As a result, it also becomes difficult to ensure the delayed fracture resistance. On the other hand, when the Al content exceeds 0.0100%, Al becomes excessive, the number of MnS-based sulfides becomes excessive, consequently, the structure becomes brittle, and it becomes difficult to ensure the delayed fracture resistance. Furthermore, when the Al content is excessive, the Al-based oxide is formed in a cluster form, and rail breakage becomes likely to occur due to stress concentration. Therefore, the Al content is limited to 0.0020% to 0.0100%. Meanwhile, to function as a formation nucleus of a MnS-based sulfide, and prevent the clustering of an Al-based oxide, the Al content is desirably set to 0.0030% to 0.0080%. Meanwhile, during ordinary rail refining, less than 0.0020% of Al is interfused from a raw material or refractory. Therefore, the Al content in a range of 0.0020% or more represents the intentional addition of Al in a refining step.

H: 2.0 ppm (0.0002%) or less

H is an element causing delayed fracture. When the H content in a bloom before rail hot-rolling exceeds 2.0 ppm, the H content piled up in the interfaces between MnS-based sulfides and the base metal increases, and delayed fracture becomes likely to occur. Therefore, in the rail according to the embodiment, the H content is preferably set to 2.0 ppm or less. Meanwhile, the lower limit of the H content is not limited; however, when secondary refining (degassing) capability in the refining step or the dehydrogenation treatment capability of the bloom is taken into account, the H content of approximately 1.0 ppm is considered to be the limit in actual manufacturing.

In addition, to the rail having the above-described component composition, Ca, REM, Cr, Mo, Co, B, Cu, Ni, V, Nb, Ti, Zr and N may be added as necessary in addition to the above-described elements for the purpose of the improvement of the delayed fracture resistance by the fine dispersion of the Al-based oxide and the MnS-based sulfide, the improvement of the wear resistance by an increase in the hardness (strength) of the pearlite structure or the bainite structure, the improvement of the toughness, the prevention of the softening of the heat affected zones, the control of the cross-sectional hardness distribution inside the rail head section, and the like. In a case in which the above-described elements are added, the desirable amounts of the rail will be described below.

It is not always necessary to add the above-described chemical elements to a steel sheet, and therefore the lower limits of the contents of the chemical elements are all zero, and are not limited. In addition, when Ca, REM, Cr, Mo, Co, B, Cu, Ni, V, Nb, Ti, Zr and N are contained in contents less than the lower limits described below, the elements are treated as impurities.

Ca suppresses the clustering of the Al-based oxide, and finely disperses the MnS-based sulfide. REM breaks the connecting section of the clustering of the Al-based oxide, and finely disperses the MnS-based sulfide. Cr and Mo increase the equilibrium transformation point, decrease the lamellar spacing of the pearlite structure or refine the bainite structure, and improve the hardness. Co refines the base ferrite structure on an worn surface, and increases the hardness of the worn surface. B decreases the dependency of the pearlite transformation temperature on the cooling rate, and makes the hardness distribution in the rail head section uniform. In addition, B improves the hardenability of the bainite structure, and improves the hardness. Cu forms a solid solution in ferrite in the pearlite structure or the bainite structure, and increases the hardness. Ni improves the toughness and hardness of the pearlite structure or the bainite structure, and simultaneously, prevents the softening of the heat affected zone in a welded joint. V, Nb and Ti suppress the growth of austenite grains using a carbide or nitride generated during hot rolling or in the subsequent cooling process. Furthermore, V, Nb and Ti improve the toughness and hardness of the pearlite structure or the bainite structure using precipitation hardening. In addition, V, Nb and Ti stably generate a carbide or nitride during reheating, and prevent the softening of the heat affected zone in a welded joint. Zr increases the equiaxial grain ratio (obtained by dividing the width of formed equiaxial grains in the thickness direction of a cast slab by the thickness of the cast slab) of a solidification structure, thereby suppressing the formation of a segregation band in the central part of the cast bloom, and suppressing the formation of a pro-eutectoid cementite structure or martensite structure. N segregates in austenite grain boundaries, thereby accelerating pearlitic transformation or bainitic transformation, and refining the pearlite structure or bainite structure. Obtaining the above-described effects is the main purpose of adding Ca, REM, Cr, Mo, Co, B, Cu, Ni, V, Nb, Ti, Zr and N.

Ca: 0.0005% to 0.0200%

Ca is a strong deoxidizing element, and is an element that, when added, reforms an Al-based oxide to a CaOAl-based oxide or CaO, thereby preventing the clustering or coarsening of the Al-based oxide, and accelerating the finely-dispersed formation of fine MnS-based sulfide. However, when the Ca content is less than 0.0005%, the effect is weak. Therefore, to obtain the above-described effect, the lower limit of the Ca content is desirably set to 0.0005%. On the other hand, when the Ca content exceeds 0.0200%, a coarse Ca oxide is generated, and rail breakage becomes likely to occur due to stress concentration. Therefore, the upper limit of the Ca content is desirably set to 0.0200%.

REM: 0.0005% to 0.0500%

REM is the strongest deoxidizing element, and is an element that reduces the clustered Al-based oxide so as to refine the Al-based oxide, thereby accelerating the finely-dispersed formation of fine MnS-based sulfide. However, when the REM content is less than 0.0005%, the effect is small, and REM does not act sufficiently as a formation nucleus of the MnS-based sulfide. Therefore, in a case in which REM is added, the REM content is desirably set to 0.0005% or more. On the other hand, when the REM content exceeds 0.0500%, a hard REM oxysulfide ($REM_2O_2S$) is generated, and rail breakage becomes likely to occur due to stress concentration. Therefore, the upper limit of the REM content is desirably limited to 0.0500%.

Meanwhile, REM refers to a rare earth metal such as Ce, La, Pr or Nd. The REM content limits the total content of all REMs. When the total of all contents is within the above-described range, the same effects can be obtained irrespective of the number of REMs—singular or multiple (two or more).

Cr: 0.01% to 2.00%

Cr is an element that increases the equilibrium transformation temperature, and decreases the lamellar spacing in the pearlite structure by increasing the degree of undercooling. In addition, Cr is an element that decreases the bainitic transformation temperature, and improves the hardness (strength) of the pearlite structure or bainite structure. However, when the Cr content is less than 0.01%, the effect is small, and the effect that improves the hardness of the rail is not observed. Therefore, in a case in which Cr is added, the Cr content is desirably set to 0.01% or more. On the other hand, when the Cr content exceeds 2.00%, the hardenability significantly improves, and a martensite structure having an adverse effect on toughness is formed in the rail head surface section and the like such that delayed fracture becomes likely to occur. Therefore, the Cr content is desirably limited to be in a range of 0.01% to 2.00%.

Mo: 0.01% to 0.50%

Similarly to Cr, Mo is an element that increases the equilibrium transformation temperature, and decreases the lamellar spacing in the pearlite structure by increasing the degree of undercooling. In addition, Mo is an element that stabilizes bainitic transformation and improves the hardness (strength) of the pearlite structure or bainite structure. However, when the Mo content is less than 0.01%, the effect is small, and the effect that improves the hardness of the rail is not observed. Therefore, in a case in which Mo is added, the Mo content is desirably set to 0.01% or more. On the other hand, when Mo is excessively added so that the Mo content exceeds 0.50%, the transformation rate significantly decreases, and a martensite structure having an adverse effect on to toughness is formed in the rail head surface section and the like such that delayed fracture becomes likely to occur. Therefore, the Mo content is desirably limited to be in a range of 0.01% to 0.50%.

Co: 0.01% to 1.00%

Co is an element that forms a solid solution in ferrite in the pearlite structure or the base ferrite structure in the bainite structure, and further refines a fine ferrite structure formed by the contact with a wheel on the worn surface of the rail head surface section, thereby increasing the hardness of the ferrite structure and improving the wear resistance. However, when the Co content is less than 0.01%, the refining of the ferrite structure is not accelerated, and the effect that improves the wear resistance cannot be expected. Therefore, in a case in which Co is added, the Co content is desirably set to 0.01% or more. On the other hand, when the Co content exceeds 1.00%, the above-described effects are saturated, and therefore the refining of the ferrite structure in accordance with the content is not achieved, and economic efficiency decreases due to an increase in the alloy addition costs. Therefore, the Co content is desirably limited to be in a range of 0.01% to 1.00%.

B: 0.0001% to 0.0050%

B is an element that forms iron boroncarbide ($Fe_{23}(CB)_6$) in austenite grain boundaries, and reduces the dependency of the pearlitic transformation temperature on the cooling rate through the pearlitic transformation-accelerating effect. In addition, as a result, a more uniform hardness distribution is supplied to the inside of the rail from the surface of the head section, and it is possible to extend the service life of the rail. Furthermore, B improves the hardenability of the bainite structure, and improves the hardness of the bainite structure. However, when the B content is less than 0.0001%, the effect is not sufficient, and there is no improvement in the hardness distribution in the rail head section. Therefore, in a case in which B is added, the B content is desirably set to 0.0001% or more. On the other hand, when the B content exceeds 0.0050%, coarse iron boron carbide is formed, and rail breakage becomes likely to occur due to stress concentration. Therefore, the B content is desirably limited in a range of 0.0001% to 0.0050%.

Cu: 0.01% to 1.00%

Cu is an element that forms a solid solution in ferrite in the pearlite structure or the base ferrite structure in the bainite structure, and improves the hardness (strength) through solid solution strengthening, thereby improving the wear resistance. However, when the Cu content is less than 0.01%, the effect cannot be expected. On the other hand, when the Cu content exceeds 1.00%, a martensite structure having an adverse effect on toughness is formed in the rail head surface section and the like due to the significant improvement of hardenability, and delayed fracture becomes likely to occur. Therefore, the Cu content is desirably limited to be in a range of 0.01% to 1.00%.

Ni: 0.01% to 1.00%

Ni is an element that improves the toughness of the pearlite structure or the bainite structure, and simultaneously, improves the hardness (strength) through solid solution strengthening, thereby improving the wear resistance. Furthermore, Ni forms $Ni_3Ti$ intermetallic compound together with Ti, finely precipitates in the heat affected zones, and suppresses softening through precipitation strengthening. In addition, Ni is an element that suppresses the intergranular embrittlement in Cu-added steel. However, when the Ni content is less than 0.01%, the effect is significantly small. On the other hand, when the Ni content exceeds 1.00%, a martensite structure having an adverse effect on toughness is formed in the rail head surface section and the like due to the significant improvement of hardenability, and delayed fracture becomes likely to occur. Therefore, the Ni content has been limited in a range of 0.01% to 1.00%.

V: 0.005% to 0.50%

V is an element that precipitates in a form of a V carbide or V nitride in a case in which ordinary hot rolling or a heat treatment in which steel is heated to a high temperature is carried out. The precipitated V carbide or V nitride refines austenite grains using the pining effect, and improves the toughness of the pearlite structure or the bainite structure. Furthermore, the V nitride and V carbide formed in a cooling process after hot rolling increases the hardness (strength) of the pearlite structure or the bainite structure using precipitation hardening, and improves the wear resistance. In addition, since V forms a V carbide or V nitride in a relatively high temperature range in a heat affected zone reheated in a temperature range that is equal to or lower than Ac1 point, V is an effective element for preventing the softening of the heat affected zone in a welded joint. However, when the V content is less than 0.005%, the above-described effect cannot be sufficiently expected, and the toughness or hardness (strength) does not improve. On the other hand, when the V content exceeds 0.50%, the precipitation hardening of the V carbide or nitride becomes excessive, the pearlite structure or the bainite structure embrittles, and the toughness of the rail decreases. Therefore, the V content is desirably limited to be in a range of 0.005% to 0.50%.

Nb: 0.001% to 0.050%

Similarly to V, Nb is an element that precipitates in a form of an Nb carbide or Nb nitride. In a case in which ordinary hot rolling or a heat treatment in which steel is heated to a high temperature is carried out, the Nb carbide or Nb nitride refines austenite grains using the pining effect, and improves the toughness of the pearlite structure or the bainite structure. Furthermore, the Nb nitride and Nb carbide formed in the cooling process after hot rolling increases the hardness (strength) of the pearlite structure or the bainite structure using precipitation hardening, and improves the wear resistance. In addition, since Nb stably forms an Nb carbide or Nb nitride in a wide temperature range from a low-temperature range to a high-temperature range in a heat affected zone reheated in a temperature range that is equal to or lower than Ac1 point. Therefore, Nb is an effective element for preventing the softening of the heat affected zone in a welded joint. However, when the Nb content is less than 0.001%, the above-described effect cannot be expected, and the toughness or hardness (strength) of the pearlite structure does not improve. On the other hand, when the Nb content exceeds 0.050%, the precipitation hardening of the Nb carbide or nitride becomes excessive, the pearlite structure or the bainite structure embrittles, and the toughness of the rail decreases. Therefore, the Nb content is desirably limited in a range of 0.001% to 0.050%.

Ti: 0.0050% to 0.0500%

Ti is an element that precipitates in a form of a Ti carbide or Ti nitride in a case in which ordinary hot rolling or a heat treatment in which steel is heated to a high temperature is carried out. The Ti carbide or Ti nitride refines austenite grains using the pining effect, and improves the toughness of the pearlite structure or the bainite structure. Furthermore, the Ti nitride and Ti carbide formed in the cooling process after hot rolling increases the hardness (strength) of the pearlite structure or the bainite structure using precipitation hardening, and improves the wear resistance. In addition, Ti refines structures in a heat affected zone heated up to the austenite range using the fact that the Ti carbide or Ti nitride precipitated during reheating in welding does not melt, and is an effective element for preventing the embrittlement of a welded joint section. However, when the Ti content is less than 0.0050%, the above-described effect cannot be sufficiently obtained. On the other hand, when the Ti content exceeds 0.0500%, a coarse Ti carbide or Ti nitride is formed, and rail breakage becomes likely to occur due to stress concentration. Therefore, the Ti content is desirably limited in a range of 0.0050% to 0.0500%.

Zr: 0.0001% to 0.0200%

Zr is an element that forms a $ZrO_2$-based inclusion with O in steel. Since the $ZrO_2$-based inclusion has favorable lattice consistency with gamma-Fe, the $ZrO_2$-based inclusion serves as a solidification nucleus of a high-carbon rail in which the gamma-Fe is a solidified primary phase, and increases the equiaxial grain ratio of a solidification structure. That is, Zr is an element that suppresses the formation of a segregation band in the central part of the cast bloom, and suppresses the formation of a martensite structure or pro-eutectoid cementite structure formed in a rail segregation section. However, when the Zr content is less than 0.0001%, the number of the $ZrO_2$-based inclusions decreases, and the $ZrO_2$-based inclusion does not sufficiently serve as a solidification nucleus. As a result, a martensite or pro-eutectoid cementite structure is formed in the segregation section, and it is not possible to sufficiently improve the toughness of the rail. On the other hand, when the Zr content exceeds 0.0200%, a large amount of a coarse $ZrO_2$-based inclusion is formed, and rail breakage becomes likely to occur due to stress concentration. Therefore, the Zr content is desirably limited in a range of 0.0001% to 0.0200%.

N: 0.0060% to 0.0200%

N is an effective element for improving the toughness by mainly refining structures through segregation in the austenite grain boundaries and accelerating of the pearlitic transformation or the bainitic transformation from the austenite grain boundaries. In addition, N is an element that accelerates the precipitation of VN or AlN when being added together with V or Al. VN or AlN is effective for improving the toughness of the pearlite structure or the bainite structure by refining austenite grains using the pining effect in a case in which ordinary hot rolling or a heat treatment in which steel is heated to a high temperature is carried out. However, when the N content is less than 0.0060%, the above-described effect is weak. On the other hand, when the N content exceeds 0.0200%, it becomes difficult to form a solid solution in steel, air bubbles serving as the starting point for fatigue damage are generated, and rail breakage becomes likely to occur. Therefore, the N content is desirably limited in a range of 0.0060% to 0.0200%.

The rail according to the embodiment may further contain elements other than the above-described elements as impurities as long as the properties are not impaired. Examples of the impurities include impurities contained in a raw material such as an ore or scrap and impurities interfused in a manufacturing step.

A rail including the above-described component composition is manufactured by melting steel in an ordinarily-used melting furnace such as a converter or an electric furnace, casting an ingot from the molten steel, blooming or continuously casting the ingot, and then hot-rolling the ingot. Furthermore, a heat treatment is carried out for the purpose of controlling the metallographic structure in the rail head top section as necessary.

(2) the Reason for Limiting the Metallographic Structure

The reason for limiting the metallographic structure of steel in the rail according to the embodiment will be described in detail.

In the rail according to the embodiment, it is important for the head surface section of the rail to mainly include the pearlite structure or the bainite structure.

First, the reason for limiting the structure to the pearlite structure or the bainite structure will be described.

In the rail head surface section that comes into contact with a wheel, it is most important to ensure wear resistance and rolling fatigue damage resistance. As a result of investigating the relationship between the metallographic structure and the above-described properties, it was confirmed that the properties were most favorable in a pearlite structure and a bainite structure. Furthermore, regarding delayed fracture resistance as well, it was confirmed by tests that, when a pearlite structure and a bainite structure are used, the delayed fracture resistance does not degrade. Therefore, the structure in the head surface section of the rail has been limited to a pearlite structure or a bainite structure for the purpose of ensuring wear resistance, rolling fatigue damage resistance and delayed fracture resistance.

The distinctive use of the pearlite structure and the bainite structure is not particularly limited, but the pearlite structure is desirable for tracks in which wear resistance is important, and the bainite structure is desirable for tracks in which rolling fatigue damage resistance is important. In addition, a mixed structure of both structures may be used.

Figure 2:
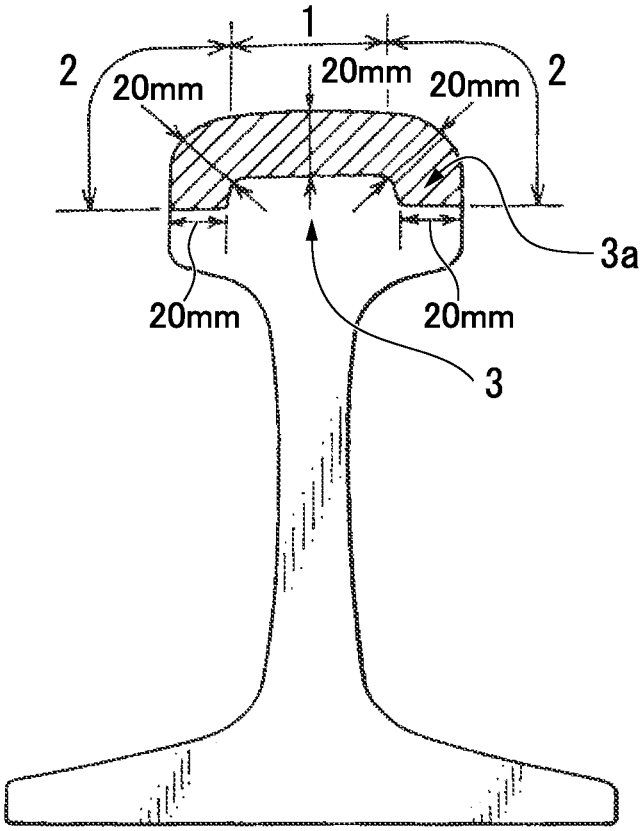
FIG. 2 is a view illustrating the names of surface locations on a cross section of a head section of a rail according to an embodiment and regions in which a pearlite structure or a bainite structure is required.

FIG. 2 illustrates the names of surface locations on a cross section of the head section of the rail according to the embodiment and regions in which the pearlite structure or the bainite structure is required. A rail head section 3 includes a head top section 1 and head corner sections 2 located at both ends of the head top section 1. One of the head corner sections 2 is a gauge corner (G.C.) section that mainly comes into contact with a wheel.

A range from the surfaces of the head corner sections 2 and the head top section 1 as the starting point to a depth of 20 mm is called a head surface section (3*a*, hatched section). As illustrated in FIG. 2, when the pearlite structure or the bainite structure is disposed in the head surface section that is the range from the surfaces of the head corner sections 2 and the head top section 1 as the starting point to a depth of 20 mm, in the rail, wear resistance and rolling fatigue damage resistance are ensured, and delayed fracture resistance is improved.

Therefore, it is desirable to dispose the pearlite structure or the bainite structure in the head surface section at which the rail mainly comes into contact with a wheel, and delayed fracture resistance is required. Other sections not requiring the above-described properties may include metallographic structures other than the pearlite structure and the bainite structure.

The hardness of the above-described metallographic structures is not particularly limited. The hardness is desirably adjusted depending on the conditions of a track to be constructed. Meanwhile, the hardness Hv is desirably controlled in a range of approximately 300 to 500 in terms of Vickers hardness to sufficiently ensure wear resistance or rolling fatigue damage resistance. A desirable method for obtaining the pearlite structure or the bainite structure having a hardness Hv in a range of 300 to 500 is that an appropriate alloy is selected, and accelerated cooling is carried out on a high-temperature rail head section in which a hot-rolled or reheated austenite region is present. When the method described in Patent Documents 8, 9, 10 or the like is used as the method for the accelerated cooling, it is possible to obtain a predetermined structure and hardness.

The metallographic structure of the head surface section of the rail according to the embodiment is desirably made up of the above-limited pearlite structure and/or bainite structure. However, depending on the component system of the rail or the heat treatment manufacturing method, there is a case in which an extremely small amount of a pro-eutectoid ferrite structure, pro-eutectoid cementite structure or martensite structure that occupies 5% or less of the above-described structures in terms of area ratio is interfused. However, even when the above-described structure is interfused, there is no large adverse effect on the delayed fracture resistance of the rail or the wear resistance and rolling fatigue damage resistance of the head surface section as long as the amount of the structure is small. Therefore, the metallographic structure of the head surface section of the rail according to the embodiment may include an extremely small amount, 5% or less, of the pro-eutectoid ferrite structure, the pro-eutectoid cementite structure and the martensite structure. In other words, the metallographic structure of the head surface section of the rail according to the embodiment may include 95% to 100% of the pearlite structure or the bainite structure or a mixed structure of the pearlite structure and the bainite structure. To ensure delayed fracture resistance, and sufficiently improve wear resistance or rolling fatigue damage resistance, it is desirable to form 98% or more of the metallographic structure of the head surface section with the pearlite structure or the bainite structure. Meanwhile, in the microstructure column in Tables 1-3, 1-4 and 2-2, structures of 5% or less are not described, and therefore all described structures other than the pearlite structure or the bainite structure have an amount of more than 5% in terms of area ratio.

(3) The Reason for Limiting the Number Per Unit Area of the MnS-Based Sulfides Formed Around an Al-Based Oxide as a Nucleus and Having a Grain Size in a Range of 1 μm to 10 μm The reason for limiting the grain size of the MnS-based sulfide grain formed around an Al-based oxide as a nucleus on an arbitrary horizontal cross section that is an evaluation subject in the rail according to the embodiment in a range of 1 μm to 10 μm will be described in detail.

As a result of a variety of melting tests, when the grain size of the MnS-based sulfide grain formed around an Al-based oxide as a nucleus exceeds 10 μm, the effect of the grain as a hydrogen trap site decreases due to a decrease in the surface area per unit volume. In addition, stress concentration or structure embrittlement occurs due to the coarsening of the MnS-based sulfides formed around an Al-based oxide as a nucleus or an increase in the formation density and thereby, rail breakage becomes likely to occur. In addition, when the grain size of the MnS-based sulfide grain formed around an Al-based oxide as a nucleus is less than 1 μm, the effect of the grain as a hydrogen trap site increases, but it is difficult to control the MnS-based sulfides during the manufacturing of the rail. Furthermore, in a case in which a heat treatment or the like is carried out after the manufacturing, the MnS-based sulfide is re-melted, and the effect of the grain as a hydrogen trap site significantly decreases. When the grain size of the MnS-based sulfide grain formed around an Al-based oxide as a nucleus is in a range of 1 μm to 10 μm, since it is possible to ensure the surface area of interfaces between the base metal and inclusions, the MnS-based sulfides formed around an Al-based oxide as a nucleus become capable of serving as sufficient hydrogen trap sites. Furthermore, since inclusions (the MnS-based sulfide grain formed around an Al-based oxide as a nucleus) are finely dispersed, it is possible to decrease the amount of hydrogen trapped by the respective inclusions. As a result, the delayed fracture resistance improves. Therefore, the grain size of the MnS-based sulfide grain formed around an Al-based oxide as a nucleus has been limited in a range of 1 μm to 10 μm.

Meanwhile, the grain size of the MnS-based sulfide grain formed around an Al-based oxide as a nucleus can be obtained by measuring the cross-sectional area, converting the cross-sectional area to an equivalent circle cross section, and computing the grain size.

Next, the reason for limiting the number of MnS-based sulfides formed around an Al-based oxide as a nucleus and having a grain size in a range of 1 μm to 10 μm on an arbitrary horizontal cross section of the rail according to the embodiment in a range of 20 to 200 per square millimeter of an area to be inspected will be described in detail.

When the MnS-based sulfides formed around an Al-based oxide as a nucleus and having a grain size in a range of 1 μm to 10 μm is less than 20 per square millimeter of an area to be inspected, it becomes difficult to ensure the surface area of interfaces between the base metal and inclusions, and the inclusions (the MnS-based sulfide grain formed around an Al-based oxide as a nucleus) do not function as sufficient hydrogen trap sites. In addition, when the MnS-based sulfides formed around an Al-based oxide as a nucleus and having a grain size in a range of 1 μm to 10 μm per square millimeter of an area to be inspected exceeds 200, the amount of the sulfide becomes excessive, the metallographic structure becomes brittle, and rail breakage becomes likely to occur. Therefore, in the rail according to the embodiment, the MnS-based sulfides formed around an Al-based oxide as a nucleus and having a grain size in a range of 1 μm to 10 μm per square millimeter of an area to be inspected has been limited to be in a range of 20 to 200.

The above-described MnS-based sulfides formed around an Al-based oxide as a nucleus refer to an inclusion having an Al-based oxide in the vicinity of the central part of the MnS-based sulfide grain and an MnS-based sulfide coating the surrounding of the Al-based oxide. The presence ratio between the Al-based oxide and the MnS-based sulfide is not particularly limited, but the presence ratio of the Al-based oxide is desirably 30% or less in terms of area ratio to ensure the ductility of the inclusion and to suppress the fracture of the rail.

While the effect can be obtained without limiting the lower limit of the area ratio, regarding the inclusions present in the rail of the embodiment, the lower limit of the area ratio of the Al-based oxide is desirably set to 5%.

Regarding the Al-based oxide that is a nucleus and the MnS-based sulfide coating the surrounding of the Al-based oxide, the inclusion may include elements other than the Al-based oxide and the MnS-based sulfide. Other elements may be partially interfused. To more stably improve the delayed fracture resistance using the MnS-based sulfides formed around an Al-based oxide as a nucleus and having a grain size in a range of 1 μm to 10 μm, the area ratio of $Al_2O_3$ is desirably 60% or more in the Al-based oxide that is a nucleus, and the area ratio of MnS is desirably 80% or more in the MnS-based sulfide coating the surrounding of the Al-based oxide.

The number of MnS-based sulfides formed around an Al-based oxide as a nucleus and having a grain size in a range of 1 μm to 10 μm was measured from a sample cut out from a horizontal cross section of the rail head section as illustrated in FIG. 3. Each cut-out sample was mirror-polished, on an arbitrary cross-section, MnS-based sulfides formed around an Al-based oxide as a nucleus were inspected using an optical microscope or a scanning microscope, the number of inclusions having the above-limited size was counted, and the number was converted to the number per unit cross-section. The representative values of individual rails described in examples are the average values of numbers measured at 20 visual fields.

The determination of the MnS-based sulfide grain formed around an Al-based oxide as a nucleus (determination of the inclusion) was carried out by sampling a typical inclusion in advance, and carrying out an electron probe micro-analysis (EPMA). The differentiation of inclusions was carried out using properties (form or color) in the optical microscopic or scanning microscopic photographs of the specified inclusion as basic information.

The measurement location of the MnS-based sulfide grain is not particularly limited, but the MnS-based sulfide grain is desirably measured in a range of 10 mm to 20 mm deep from the rail head surface section as illustrated in FIG. 3.

In the rail according to the embodiment, there is a case in which there are MnS-based sulfides that are not formed around an Al-based oxide as a nucleus. However, the number of such MnS-based sulfides that are not formed around an Al-based oxide as a nucleus is small, and the MnS-based sulfides do not contribute to delayed fracture resistance, and therefore the MnS-based sulfides are not counted.

(4) the Control Method of the Al-Based Oxide

Regarding the control of the fine Al-based oxide that serves as a nucleus of the MnS-based sulfide grain, an example of a manufacturing method will be described.

Al is a strong deoxidizing element, and, when metallic aluminum (for example, Al grains called shot aluminum or the like) is added to molten steel, the metallic aluminum reacts with free oxygen in the molten steel, thereby forming $Al_2O_3$. The $Al_2O_3$ is likely to do clustering, and consequently coarsens an Al-based oxide. When a coarsened Al-based oxide is present, rail breakage becomes likely to occur due to stress concentration. Therefore, preventing the coarsening of the Al-based oxide is important for improving delayed fracture resistance.

A method for preventing the coarsening of the Al-based oxide can be appropriately selected. For example, it is possible to preliminarily deoxidize molten steel in advance using an element having a stronger oxidizing force than Al (REM or the like), decrease the oxygen amount as much as possible so as to decrease the Al content to the necessary minimum content, and refine the Al-based oxide.

In addition, on the contrary to the above-described method, for example, it is also possible to inject a batch of a necessary amount of Al for deoxidation in a state in which a large amount of free oxygen is contained in molten steel without carrying out preliminary deoxidation, accelerate the formation or levitation of coarse $Al_2O_3$ clusters, and use the residual fine Al-based oxide.

In addition, for the purpose of controlling the formation of a coarse Al-based oxide through reoxidation from slag, it is also possible to intensify slag ejection in addition to the above-described deoxidation control.

A method of removing the coarsened Al-based oxide can be appropriately selected. For example, to levitate the Al-based oxide, it is possible to apply blowing of Ar in a ladle after refining, blowing of fine air bubbles in a tundish before casting or the like. In addition, for the purpose of suppressing the agglomeration of the Al-based oxide or accelerating the levitation of the coarse Al-based oxide during casting, it is possible to apply electromagnetic stirring in a tundish.

In addition to the above-described control in molten steel, a strong rolling reduction may be added to solid-phase steel in which the MnS-based sulfide is yet to be formed through hot-rolling. The strong rolling reduction during hot-rolling can finely crush the coarsened Al-based oxide. When the Al-based oxide is finely crushed, the MnS-based sulfides are also dispersedly formed, and the delayed fracture resistance further improves. Meanwhile, the strong rolling reduction refers to a rolling reduction with a reduction of 30% or more per pass during hot rolling.

(5) The Method of Controlling the S Content

Regarding the method of controlling the S content for controlling the number of fine MnS-based sulfides, an example of a manufacturing method will be described.

A large amount of S is contained as an impurity in a molten iron. It is normal to control the S content in a converter. In a converter, CaO is added, and S is ejected into slag in a form of CaS. When refining is carried out in an ordinary converter, the S content is reduced to 0.0030% to 0.0300%. When the S content is controlled to more than 0.0100% to 0.0250% by controlling the desulfurization treatment time or the CaO content in the converter, and the number of the MnS-based sulfides formed around an Al-based oxide as a nucleus and having a grain size in a range of 1 μm to 10 nm is increased, it is possible to improve the delayed fracture resistance.

(6) The Method of Controlling the H Content

Regarding the control of the H content further improving the delayed fracture resistance, an example of a manufacturing method will be described.

H is contained in a molten iron as an impurity. It is normal to control the H content during secondary refining (degassing) in the converter. During the secondary refining, a ladle is put into a vacuum state, and H in steel is exhausted. The H content can be controlled to 2.0 ppm or less by controlling the treatment time during the secondary refining, and it is possible to further improve the delayed fracture resistance.

Hydrogen intrudes from the atmosphere after the above-described refining, and there is a case in which the amount of hydrogen in a bloom after casting is increased. In such a case, it is possible to apply a method in which the bloom is cooled slowly or reheated, thereby diffusing hydrogen inside the bloom outside.

EXAMPLE

Next, examples of the present invention will be described.

Tables 1-1 to 1-4 describe the chemical components and various properties of Invention Rails. Tables 1-1 and 1-2 describe the chemical component values, Tables 1-3 and 1-4 describe the microstructures of the head surface sections, the hardness of the head surface sections and the number of the MnS-based sulfide grains formed around an Al-based oxide as a nucleus and having a grain size in a range of 1 μm to 10 μm. Furthermore, Tables 1-3 and 1-4 also describe the results of the delayed fracture tests (limit stress values) carried out using a method illustrated in FIG. 6A. The microstructures of the head surface sections in Tables 1-3 and 1-4 include microstructures into which a small amount, 5% or less in terms of area ratio, of a pro-eutectoid ferrite structure, pro-eutectoid cementite structure or martensite structure is interfused.

Tables 2-1 and 2-2 describe the chemical components and various properties of Comparative Rails. Table 2-1 describes the chemical component values, Table 2-2 describes the microstructures of the head surface sections, the hardness of the head surface sections and the number of the MnS-based sulfide grains formed around an Al-based oxide as a nucleus and having a grain size in a range of 1 μm to 10 μm. Furthermore, Table 2-2 also describe the results of the delayed fracture tests (limit stress values) carried out using a method illustrated in FIG. 6A. In the microstructures of the head surface sections in Table 2-2, regarding Comparative Examples into which more than 5% in terms of area ratio of a pro-eutectoid ferrite structure, pro-eutectoid cementite structure or martensite structure is interfused, the pro-eutectoid ferrite structure, pro-eutectoid cementite structure or martensite is also described in the column of the microstructure of the head surface section.

"–" in Tables 1-1, 1-2 and 2-1 indicates that the content has been equal to or less than the measurement limit value.

The manufacturing conditions of Invention Rails and Comparative Rails described in Tables 1-1 to 1-4, 2-1 and 2-2 are as described below.

Molten steel→component adjustment (converter and secondary refining: degassing)→casting (bloom)→reheating (1250° C.)→hot rolling (finishing temperature 950° C.)→heat treatment (initial temperature 800° C., accelerated cooling)→air cooling On some steel Nos., treatments as described in the special instruction column in Tables 1-3, 1-4 and 2-2 were carried out.

TABLE 1-1

| STEEL No. | CHEMICAL COMPONENTS (mass %) | | | | | | | | | |
|---|---|---|---|---|---|---|---|---|---|---|
| | C | Si | Mn | P | Al | S | H (ppm) | Ca | REM | Cr |
| A1 | 0.70 | 0.50 | 0.80 | 0.0100 | 0.0030 | 0.0120 | 2.30 | — | — | — |
| A2 | 1.20 | 0.50 | 0.80 | 0.0100 | 0.0030 | 0.0120 | 2.30 | — | — | — |
| A3 | 0.90 | 0.05 | 1.10 | 0.0120 | 0.0095 | 0.0140 | 2.40 | — | — | — |
| A4 | 0.90 | 2.00 | 1.10 | 0.0120 | 0.0095 | 0.0140 | 2.40 | — | — | — |
| A5 | 0.70 | 0.70 | 0.10 | 0.0130 | 0.0050 | 0.0110 | 2.10 | — | — | — |
| A6 | 0.70 | 0.70 | 2.00 | 0.0130 | 0.0050 | 0.0110 | 2.10 | — | — | — |
| A7 | 0.95 | 0.50 | 0.55 | 0.0030 | 0.0040 | 0.0130 | 2.15 | — | — | — |
| A8 | 0.95 | 0.50 | 0.55 | 0.0200 | 0.0040 | 0.0130 | 2.15 | — | — | — |
| A9 | 1.00 | 0.25 | 0.80 | 0.0150 | 0.0020 | 0.0150 | 2.25 | — | — | — |
| A10 | 1.00 | 0.25 | 0.80 | 0.0150 | 0.0100 | 0.0150 | 2.25 | — | — | — |
| A11 | 0.90 | 0.35 | 1.00 | 0.0140 | 0.0050 | 0.0101 | 2.30 | — | — | — |
| A12 | 0.90 | 0.35 | 1.00 | 0.0140 | 0.0050 | 0.0250 | 2.30 | — | — | — |
| A13 | 0.75 | 0.50 | 1.00 | 0.0180 | 0.0030 | 0.0120 | 2.30 | — | — | — |
| A14 | 0.80 | 0.30 | 0.85 | 0.0175 | 0.0025 | 0.0105 | 2.20 | — | — | 0.25 |
| A15 | 0.80 | 0.30 | 0.85 | 0.0175 | 0.0025 | 0.0145 | 2.20 | — | — | 0.25 |
| A16 | 0.80 | 0.30 | 0.85 | 0.0175 | 0.0025 | 0.0145 | 1.80 | — | — | 0.25 |
| A17 | 0.80 | 0.25 | 0.85 | 0.0140 | 0.0055 | 0.0120 | 2.10 | — | — | 0.15 |
| A18 | 0.80 | 0.25 | 0.85 | 0.0140 | 0.0055 | 0.0150 | 2.10 | — | — | 0.15 |
| A19 | 0.80 | 0.25 | 0.85 | 0.0140 | 0.0055 | 0.0150 | 1.80 | — | — | 0.15 |
| A20 | 0.85 | 0.50 | 0.70 | 0.0190 | 0.0040 | 0.0150 | 2.20 | — | — | — |
| A20X | 0.85 | 0.50 | 0.70 | 0.0190 | 0.0040 | 0.0150 | 2.20 | — | — | 0.55 |
| A21 | 0.85 | 0.50 | 1.45 | 0.0185 | 0.0040 | 0.0150 | 2.30 | — | — | — |
| A22 | 0.90 | 0.80 | 0.85 | 0.0035 | 0.0045 | 0.0120 | 2.20 | — | — | — |
| A23 | 0.90 | 0.80 | 0.85 | 0.0035 | 0.0045 | 0.0180 | 2.20 | — | — | — |
| A24 | 0.90 | 0.80 | 0.85 | 0.0035 | 0.0045 | 0.0180 | 1.60 | — | — | — |
| A25 | 0.95 | 0.45 | 1.65 | 0.0140 | 0.0030 | 0.0120 | 2.15 | — | — | — |
| A26 | 0.98 | 0.30 | 1.05 | 0.0190 | 0.0040 | 0.0120 | 2.30 | — | — | — |
| A27 | 1.00 | 0.45 | 1.05 | 0.0150 | 0.0060 | 0.0130 | 2.40 | — | — | — |
| A28 | 1.00 | 0.30 | 0.90 | 0.0140 | 0.0085 | 0.0125 | 2.30 | — | 0.0085 | 0.20 |

| STEEL No. | CHEMICAL COMPONENTS (mass %) | | | | | | | | | |
|---|---|---|---|---|---|---|---|---|---|---|
| | Mo | Co | B | Cu | Ni | V | Nb | Ti | Zr | N |
| A1 | — | — | — | — | — | — | — | — | — | — |
| A2 | — | — | — | — | — | — | — | — | — | — |
| A3 | — | — | — | — | — | — | — | — | — | — |
| A4 | — | — | — | — | — | — | — | — | — | — |
| A5 | — | — | — | — | — | — | — | — | — | — |
| A6 | — | — | — | — | — | — | — | — | — | — |
| A7 | — | — | — | — | — | — | — | — | — | — |
| A8 | — | — | — | — | — | — | — | — | — | — |
| A9 | — | — | — | — | — | — | — | — | — | — |
| A10 | — | — | — | — | — | — | — | — | — | — |
| A11 | — | — | — | — | — | — | — | — | — | — |
| A12 | — | — | — | — | — | — | — | — | — | — |
| A13 | — | — | — | 0.15 | — | — | — | — | — | — |
| A14 | — | — | — | — | — | — | — | — | — | — |
| A15 | — | — | — | — | — | — | — | — | — | — |
| A16 | — | — | — | — | — | — | — | — | — | — |
| A17 | 0.05 | — | — | — | — | — | — | — | — | — |
| A18 | 0.05 | — | — | — | — | — | — | — | — | — |
| A19 | 0.05 | — | — | — | — | — | — | — | — | — |
| A20 | — | — | — | — | 0.25 | — | — | — | — | — |
| A20X | — | — | — | — | — | — | — | — | — | — |
| A21 | 0.07 | — | — | — | — | — | — | — | — | — |
| A22 | — | — | — | — | — | — | — | — | — | — |
| A23 | — | — | — | — | — | — | — | — | — | — |
| A24 | — | — | — | — | — | — | — | — | — | — |
| A25 | — | — | — | — | — | — | — | — | — | — |
| A26 | — | 0.15 | — | — | — | — | — | — | — | — |
| A27 | — | — | 0.0015 | — | — | — | — | 0.0120 | — | — |
| A28 | — | — | — | — | — | — | — | — | — | — |

TABLE 1-2

| STEEL No. | CHEMICAL COMPONENTS (mass %) C | Si | Mn | P | Al | S | H (ppm) | Ca | REM | Cr |
|---|---|---|---|---|---|---|---|---|---|---|
| A29 | 1.00 | 0.30 | 0.90 | 0.0140 | 0.0085 | 0.0150 | 2.30 | — | 0.0085 | 0.20 |
| A30 | 1.00 | 0.30 | 0.90 | 0.0140 | 0.0085 | 0.0150 | 1.50 | — | 0.0085 | 0.20 |
| A31 | 1.00 | 0.80 | 0.80 | 0.0110 | 0.0035 | 0.0135 | 2.20 | 0.0015 | — | — |
| A32 | 1.01 | 0.25 | 1.45 | 0.0160 | 0.0060 | 0.0120 | 2.30 | — | — | — |
| A33 | 1.01 | 0.25 | 1.45 | 0.0160 | 0.0060 | 0.0170 | 2.30 | — | — | — |
| A34 | 1.01 | 0.25 | 1.45 | 0.0160 | 0.0060 | 0.0170 | 1.00 | — | — | — |
| A35 | 1.02 | 0.45 | 0.80 | 0.0080 | 0.0050 | 0.0105 | 2.15 | — | — | — |
| A36 | 1.02 | 0.45 | 0.80 | 0.0080 | 0.0050 | 0.0130 | 2.15 | — | — | — |
| A37 | 1.02 | 0.45 | 0.80 | 0.0080 | 0.0050 | 0.0130 | 1.50 | — | — | — |
| A38 | 1.06 | 0.55 | 0.85 | 0.0135 | 0.0070 | 0.0120 | 2.30 | — | — | — |
| A39 | 1.06 | 0.55 | 0.85 | 0.0135 | 0.0070 | 0.0155 | 2.30 | — | — | — |
| A40 | 1.06 | 0.55 | 0.85 | 0.0135 | 0.0070 | 0.0155 | 1.90 | — | — | — |
| A41 | 1.10 | 1.40 | 0.75 | 0.0060 | 0.0045 | 0.0240 | 2.10 | — | — | — |
| A42 | 1.10 | 1.40 | 0.75 | 0.0060 | 0.0045 | 0.0190 | 2.10 | — | — | — |
| A43 | 1.10 | 1.40 | 0.75 | 0.0060 | 0.0045 | 0.0190 | 1.00 | — | — | — |
| A44 | 1.10 | 1.40 | 0.75 | 0.0060 | 0.0045 | 0.0190 | 1.50 | — | — | — |
| A45 | 1.10 | 1.40 | 0.75 | 0.0060 | 0.0045 | 0.0190 | 1.95 | — | — | — |
| A46 | 1.10 | 1.00 | 1.65 | 0.0115 | 0.0085 | 0.0150 | 2.30 | — | — | — |
| A46X | 1.10 | 1.00 | 0.55 | 0.0115 | 0.0085 | 0.0150 | 2.30 | — | — | — |
| A47 | 1.15 | 1.00 | 0.30 | 0.0135 | 0.0035 | 0.0120 | 2.40 | — | — | 0.35 |
| A48 | 1.15 | 1.00 | 0.30 | 0.0135 | 0.0035 | 0.0180 | 2.40 | — | — | 0.35 |
| A49 | 1.15 | 1.00 | 0.30 | 0.0135 | 0.0035 | 0.0180 | 1.20 | — | — | 0.35 |
| A50 | 1.20 | 1.65 | 1.00 | 0.0140 | 0.0060 | 0.0125 | 2.30 | — | — | — |

| STEEL No. | CHEMICAL COMPONENTS (mass %) Mo | Co | B | Cu | Ni | V | Nb | Ti | Zr | N |
|---|---|---|---|---|---|---|---|---|---|---|
| A29 | — | — | — | — | — | — | — | — | — | — |
| A30 | — | — | — | — | — | — | — | — | — | — |
| A31 | — | — | — | — | — | — | — | — | — | — |
| A32 | — | — | — | — | — | 0.02 | 0.0045 | — | — | — |
| A33 | — | — | — | — | — | 0.02 | 0.0045 | — | — | — |
| A34 | — | — | — | — | — | 0.02 | 0.0045 | — | — | — |
| A35 | — | — | — | — | — | — | — | — | — | — |
| A36 | — | — | — | — | — | — | — | — | — | — |
| A37 | — | — | — | — | — | — | — | — | — | — |
| A38 | — | — | — | — | — | 0.04 | — | — | — | 0.0065 |
| A39 | — | — | — | — | — | 0.04 | — | — | — | 0.0065 |
| A40 | — | — | — | — | — | 0.04 | — | — | — | 0.0065 |
| A41 | — | — | — | — | — | — | — | — | — | — |
| A42 | — | — | — | — | — | — | — | — | — | — |
| A43 | — | — | — | — | — | — | — | — | — | — |
| A44 | — | — | — | — | — | — | — | — | — | — |
| A45 | — | — | — | — | — | — | — | — | — | — |
| A46 | — | — | — | — | — | — | — | — | — | — |
| A46X | — | — | — | — | — | — | — | — | — | — |
| A47 | — | — | — | — | — | — | — | — | — | — |
| A48 | — | — | — | — | — | — | — | — | — | — |
| A49 | — | — | — | — | — | — | — | — | — | — |
| A50 | — | — | — | — | — | — | — | — | 0.0025 | — |

TABLE 1-3

| STEEL No. | MICRO-STRUCTURE IN HEAD SURFACE SECTION | HARDNESS OF HEAD SURFACE SECTION (Hv.98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD | |
|---|---|---|---|---|---|---|
| A1 | PEARLITE (96%) | 310 | 45 | 290 | — | INVENTION EXAMPLE |
| A2 | PEARLITE (96%) | 375 | 45 | 275 | — | |
| A3 | PEARLITE (95%) | 350 | 75 | 375 | — | |
| A4 | PEARLITE (96%) | 450 | 75 | 355 | — | |
| A5 | PEARLITE (100%) | 320 | 45 | 330 | — | |
| A6 | PEARLITE (97%) | 425 | 45 | 315 | — | |
| A7 | PEARLITE (100%) | 400 | 135 | 375 | — | |
| A8 | PEARLITE (100%) | 400 | 135 | 350 | — | |

TABLE 1-3-continued

| STEEL No. | MICRO-STRUCTURE IN HEAD SURFACE SECTION | HARDNESS OF HEAD SURFACE SECTION (Hv.98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD |
|---|---|---|---|---|---|
| A9 | PEARLITE (100%) | 415 | 60 | 300 | — |
| A10 | PEARLITE (100%) | 415 | 142 | 385 | — |
| A11 | PEARLITE (99%) | 435 | 30 | 265 | — |
| A12 | PEARLITE (99%) | 435 | 185 | 385 | — |
| A13 | PEARLITE (98%) | 380 | 25 | 290 | — |
| A14 | PEARLITE (98%) | 390 | 30 | 270 | BLOWING OF Ar INTO MOLTEN STEEL LADLE |
| A15 | PEARLITE (98%) | 390 | 55 | 360 | BLOWING OF Ar INTO MOLTEN STEEL LADLE + DESULFURIZATION CONTROL |
| A16 | PEARLITE (98%) | 390 | 55 | 405 | BLOWING OF Ar INTO MOLTEN STEEL LADLE + DESULFURIZATION CONTROL + SECONDARY REFINING STRENGTHENING |
| A17 | BAINITE (98%) | 370 | 30 | 280 | — |
| A18 | BAINITE (98%) | 370 | 70 | 370 | BLOWING OF Ar INTO MOLTEN STEEL LADLE + DESULFURIZATION CONTROL |
| A19 | BAINITE (98%) | 370 | 70 | 415 | BLOWING OF Ar INTO MOLTEN STEEL LADLE + DESULFURIZATION CONTROL + SECONDARY REFINING STRENGTHENING |
| A20 | PEARLITE (98%) | 405 | 95 | 335 | — |
| A20X | PEARLITE (65%) + BAINITE (34%) | 380 | 95 | 350 | — |
| A21 | BAINITE (98%) | 450 | 22 | 300 | — |
| A22 | PEARLITE (99%) | 430 | 30 | 265 | — |
| A23 | PEARLITE (99%) | 430 | 65 | 365 | BLOWING OF Ar INTO MOLTEN STEEL LADLE + DESULFURIZATION CONTROL |
| A24 | PEARLITE (99%) | 430 | 65 | 410 | BLOWING OF Ar INTO MOLTEN STEEL LADLE + DESULFURIZATION CONTROL + SECONDARY REFINING STRENGTHENING + SLOW COOLING OF STEEL PIECE |
| A25 | BAINITE (100%) | 420 | 32 | 320 | — |
| A26 | PEARLITE (97%) | 410 | 42 | 300 | — |
| A27 | PEARLITE (98%) | 430 | 45 | 300 | — |
| A28 | PEARLITE (100%) | 445 | 120 | 355 | PRELIMINARY DESULFURIZATION OF REM |

TABLE 1-4

| STEEL No. | MICRO-STRUCTURE IN HEAD SURFACE SECTION | HARDNESS OF HEAD SURFACE SECTION (Hv. 98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD | |
|---|---|---|---|---|---|---|
| A29 | PEARLITE (100%) | 445 | 180 | 435 | PRELIMINARY DESULFURIZATION OF REM + DESULFURIZATION CONTROL | INVENTION EXAMPLE |
| A30 | PEARLITE (100%) | 445 | 180 | 485 | PRELIMINARY DESULFURIZATION OF REM + DESULFURIZATION CONTROL + SECONDARY REFINING STRENGTHENING + SLOW COOLING OF STEEL PIECE | |

TABLE 1-4-continued

| STEEL No. | MICRO-STRUCTURE IN HEAD SURFACE SECTION | HARDNESS OF HEAD SURFACE SECTION (Hv. 98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD |
|---|---|---|---|---|---|
| A31 | PEARLITE (98%) | 430 | 32 | 320 | — |
| A32 | BAINITE (96%) | 440 | 38 | 305 | BLOWING OF FINE AIR BUBBLES DURING CASTING |
| A33 | BAINITE (96%) | 440 | 90 | 390 | BLOWING OF FINE AIR BUBBLES DURING CASTING + DESULFURIZATION CONTROL |
| A34 | BAINITE (96%) | 440 | 90 | 450 | BLOWING OF FINE AIR BUBBLES DURING CASTING + DESULFURIZATION CONTROL + SECONDARY REFINING STRENGTHENING + SLOW COOLING OF STEEL PIECE |
| A35 | PEARLITE (99%) | 440 | 75 | 330 | BLOWING OF Ar INTO MOLTEN STEEL LADLE |
| A36 | PEARLITE (99%) | 440 | 135 | 400 | BLOWING OF Ar INTO MOLTEN STEEL LADLE + DESULFURIZATION CONTROL |
| A37 | PEARLITE (99%) | 440 | 135 | 460 | BLOWING OF Ar INTO MOLTEN STEEL LADLE + DESULFURIZATION CONTROL + SECONDARY REFINING STRENGTHENING + REHEATING OF STEEL PIECE |
| A38 | PEARLITE (99%) | 435 | 45 | 320 | — |
| A39 | PEARLITE (99%) | 435 | 80 | 380 | BLOWING OF Ar INTO MOLTEN STEEL LADLE + DESULFURIZATION CONTROL |
| A40 | PEARLITE (99%) | 435 | 80 | 425 | BLOWING OF Ar INTO MOLTEN STEEL LADLE + DESULFURIZATION CONTROL + SECONDARY REFINING STRENGTHENING |
| A41 | PEARLITE (98%) | 450 | 65 | 325 | — |
| A42 | PEARLITE (98%) | 450 | 190 | 440 | BLOWING OF Ar INTO MOLTEN STEEL LADLE + DESULFURIZATION CONTROL |
| A43 | PEARLITE (98%) | 450 | 190 | 500 | BLOWING OF Ar INTO MOLTEN STEEL LADLE + DESULFURIZATION CONTROL + SECONDARY REFINING STRENGTHENING + SLOW COOLING OF STEEL PIECE |
| A44 | PEARLITE (98%) | 450 | 190 | 490 | BLOWING OF Ar INTO MOLTEN STEEL LADLE + DESULFURIZATION CONTROL + SECONDARY REFINING STRENGTHENING + SLOW COOLING OF STEEL PIECE |
| A45 | PEARLITE (98%) | 450 | 190 | 475 | BLOWING OF Ar INTO MOLTEN STEEL LADLE + DESULFURIZATION CONTROL + SECONDARY REFINING STRENGTHENING |
| A46 | BAINITE (99%) | 475 | 100 | 360 | — |
| A46X | BAINITE (60%) + PEARLITE (38%) | 420 | 100 | 350 | — |
| A47 | PEARLITE (100%) | 460 | 80 | 320 | — |
| A48 | PEARLITE (100%) | 460 | 175 | 415 | BLOWING OF Ar INTO MOLTEN STEEL LADLE + DESULFURIZATION CONTROL |
| A49 | PEARLITE (100%) | 460 | 175 | 465 | BLOWING OF Ar INTO MOLTEN STEEL LADLE + DESULFURIZATION CONTROL + SECONDARY REFINING STRENGTHENING + SLOW COOLING OF STEEL PIECE |
| A50 | PEARLITE (98%) | 480 | 120 | 345 | — |

TABLE 2-1

| STEEL No. | CHEMICAL COMPONENTS (mass %) C | Si | Mn | P | Al | S | H (ppm) | Ca | REM | Cr |
|---|---|---|---|---|---|---|---|---|---|---|
| a1 | 0.60 | 0.50 | 0.80 | 0.0100 | 0.0030 | 0.0120 | 2.30 | — | — | — |
| a2 | 1.30 | 0.50 | 0.80 | 0.0100 | 0.0030 | 0.0120 | 2.30 | — | — | — |
| a3 | 0.90 | 0.04 | 1.10 | 0.0120 | 0.0020 | 0.0140 | 2.40 | — | — | — |
| a4 | 0.90 | 2.50 | 1.10 | 0.0120 | 0.0020 | 0.0140 | 2.40 | — | — | — |
| a5 | 0.70 | 0.70 | 0.08 | 0.0130 | 0.0025 | 0.0110 | 2.10 | — | — | — |
| a6 | 0.70 | 0.70 | 2.30 | 0.0130 | 0.0025 | 0.0110 | 2.10 | — | — | — |
| a7 | 0.95 | 0.50 | 0.55 | 0.0250 | 0.0040 | 0.0130 | 2.15 | — | — | — |
| a8 | 1.00 | 0.25 | 0.80 | 0.0150 | 0.0015 | 0.0150 | 2.25 | — | — | — |
| a9 | 1.00 | 0.25 | 0.80 | 0.0150 | 0.0120 | 0.0150 | 2.25 | — | — | — |
| a10 | 0.90 | 0.35 | 1.00 | 0.0140 | 0.0050 | 0.0090 | 2.30 | — | — | — |
| a11 | 0.90 | 0.35 | 1.00 | 0.0140 | 0.0050 | 0.0300 | 2.30 | — | — | — |
| a12 | 0.80 | 0.30 | 0.85 | 0.0175 | 0.0010 | 0.0105 | 2.20 | — | — | 0.25 |
| a13 | 0.80 | 0.25 | 0.85 | 0.0140 | 0.0015 | 0.0120 | 2.10 | — | — | 0.15 |
| a14 | 0.90 | 0.80 | 0.85 | 0.0060 | 0.0120 | 0.0120 | 2.20 | — | — | — |
| a15 | 0.95 | 0.45 | 1.65 | 0.0140 | 0.0015 | 0.0120 | 2.15 | — | — | — |
| a16 | 1.00 | 0.30 | 0.90 | 0.0140 | 0.0130 | 0.0125 | 2.30 | — | 0.0085 | 0.20 |
| a17 | 1.01 | 0.25 | 1.45 | 0.0160 | 0.0015 | 0.0120 | 2.30 | — | — | — |
| a18 | 1.02 | 0.45 | 0.80 | 0.0100 | 0.0140 | 0.0105 | 2.15 | — | — | — |
| a19 | 1,06 | 0.55 | 0.85 | 0.0135 | 0.0010 | 0.0120 | 2.30 | — | — | — |
| a20 | 1.10 | 1.40 | 0.75 | 0.0080 | 0.0145 | 0.0240 | 2.10 | — | — | — |
| a21 | 1.15 | 1.00 | 0.30 | 0.0135 | 0.0120 | 0.0135 | 2.40 | — | — | 0.35 |
| a22 | 1.20 | 1.65 | 1.00 | 0.0140 | 0.0115 | 0.0125 | 2.30 | — | — | — |

| STEEL No. | CHEMICAL COMPONENTS (mass %) Mo | Co | B | Cu | Ni | V | Nb | Ti | Zr | N |
|---|---|---|---|---|---|---|---|---|---|---|
| a1 | — | — | — | — | — | — | — | — | — | — |
| a2 | — | — | — | — | — | — | — | — | — | — |
| a3 | — | — | — | — | — | — | — | — | — | — |
| a4 | — | — | — | — | — | — | — | — | — | — |
| a5 | — | — | — | — | — | — | — | — | — | — |
| a6 | — | — | — | — | — | — | — | — | — | — |
| a7 | — | — | — | — | — | — | — | — | — | — |
| a8 | — | — | — | — | — | — | — | — | — | — |
| a9 | — | — | — | — | — | — | — | — | — | — |
| a10 | — | — | — | — | — | — | — | — | — | — |
| a11 | — | — | — | — | — | — | — | — | — | — |
| a12 | — | — | — | — | — | — | — | — | — | — |
| a13 | 0.05 | — | — | — | — | — | — | — | — | — |
| a14 | — | — | — | — | — | — | — | — | — | — |
| a15 | — | — | — | — | — | — | — | — | — | — |
| a16 | — | — | — | — | — | — | — | — | — | — |
| a17 | — | — | — | — | — | 0.02 | 0.0045 | — | — | — |
| a18 | — | — | — | — | — | — | — | — | — | — |
| a19 | — | — | — | — | — | 0.04 | — | — | — | 0.0065 |
| a20 | — | — | — | — | — | — | — | — | — | — |
| a21 | — | — | — | — | — | — | — | — | — | — |
| a22 | — | — | — | — | — | — | — | — | 0.0025 | — |

TABLE 2-2

| STEEL No. | MICROSTRUCTURE IN HEAD SURFACE SECTION | HARDNESS OF HEAD SURFACE SECTION (Hv, 98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD | |
|---|---|---|---|---|---|---|
| a1 | PRO-EUTECTOID FERRITE + PEARLITE | 280 | 30 | 220 | — | COMPARATIVE EXAMPLE |
| a2 | PEARLITE + PRO-EUTECTOIDE CEMENTITE | 435 | 30 | 200 | — | |
| a3 | PEARLITE + PRO-EUTECTOIDE CEMENTITE | 350 | 22 | 230 | — | |
| a4 | PEARLITE + MARTENSITE | 520 | 22 | 200 | — | |

TABLE 2-2-continued

| STEEL No. | MICROSTRUCTURE IN HEAD SURFACE SECTION | HARDNESS OF HEAD SURFACE SECTION (Hv, 98N) | NUMBER OF MnS-BASED SULFIDES FORMED AROUND Al-BASED OXIDE AS NUCLEUS AND HAVING GRAIN SIZE OF 1 μm TO 10 μm (GRAINS/mm$^2$) | LIMIT STRESS VALUE FROM DELAYED FRACTURE TEST (MPa) | SPECIAL INSTRUCTION OF MANUFACTURING METHOD |
|---|---|---|---|---|---|
| a5 | PRO-EUTECTOID FERRITE + PEARLITE | 270 | 25 | 230 | — |
| a6 | PEARLITE + MARTENSITE | 550 | 25 | 190 | — |
| a7 | PEARLITE (99%) | 400 | 135 | 220 | — |
| a8 | PEARLITE (98%) | 415 | 11 | 210 | — |
| a9 | PEARLITE (98%) | 415 | 225 | 220 | — |
| a10 | PEARLITE (99%) | 435 | 3 | 200 | — |
| a11 | PEARLITE (99%) | 435 | 235 | 215 | — |
| a12 | PEARLITE (98%) | 390 | 7 | 205 | BLOWING OF Ar INTO MOLTEN STEEL LADLE |
| a13 | BAINITE (98%) | 370 | 13 | 230 | — |
| a14 | PEARLITE (99%) | 430 | 240 | 210 | — |
| a15 | BAINITE (100%) | 420 | 14 | 230 | — |
| a16 | PEARLITE (98%) | 445 | 215 | 235 | PRELIMINARY DESULFURIZATION OF REM |
| a17 | BAINITE (96%) | 440 | 12 | 235 | BLOWING OF FINE AIR BUBBLES DURING CASTING |
| a18 | PEARLITE (98%) | 440 | 230 | 225 | BLOWING OF Ar INTO MOLTEN STEEL LADLE |
| a19 | PEARLITE (99%) | 435 | 10 | 230 | — |
| a20 | PEARLITE (98%) | 450 | 250 | 205 | — |
| a21 | PEARLITE (99%) | 460 | 225 | 220 | — |
| a22 | PEARLITE (100%) | 480 | 205 | 235 | — |

<Method of Determining the Amount of Hydrogen>

The method of determining the amount of hydrogen for Invention Rails and Comparative Rails described in Tables 1-1, 1-2 and 2-1 is as described below.

(1) Analysis step: molten steel was sampled from the inside of a mold during the casting of a bloom.

(2) Sample holding method: after sampling, the sample was rapidly cooled and immersed in liquid nitrogen.

(3) Analysis method: thermal conductivity method

Sample size: a cylinder with a diameter of 6 mm and a thickness of 1 mm

Heating temperature: 1900° C. (the sample was induction-heated on a graphite crucible)

Atmosphere: inert gas (Ar)

Carrier gas: $N_2$

Analyzer: thermal conductivity detector

<Hardness Measurement Method>

The microstructures of Invention Rails and Comparative Rails described in Tables 1-3, 1-4 and 2-2 were determined by observing structures at a location 3 mm deep from the surface of the rail head surface section. In addition, the hardness was measured using a Vickers hardness meter at a location 3 mm deep from the surface of the rail head surface section. The measurement method is as described below.

(1) Preliminary treatment: after the cutting of the rail, a horizontal cross section was polished.

(2) Measurement method: the hardness was measured on the basis of JIS Z 2244

(3) Measurement device: Vickers hardness meter (load 98 N)

(4) Measurement location: a location 3 mm deep from the surface of the rail head surface section (5) Number of measurements: measurements were carried out at 5 or more points, and the average value was considered to be the representative value of the rail.

<Measurement Method of the MnS-Based Sulfides Formed Around an Al-Based Oxide as a Nucleus>

The MnS-based sulfides formed around an Al-based oxide as a nucleus in Invention Rails and Comparative Rails described in Tables 1-3, 1-4 and 2-2 were measured at a location 10 mm to 20 mm deep from the surface of the rail head surface section as illustrated in FIG. 3. The measurement method is as described below.

(1) Preliminary treatment: after the cutting of the rail, a horizontal cross section was polished.

(2) Measurement method: MnS-based sulfides formed around an Al-based oxide as a nucleus were inspected using an optical microscope or a scanning microscope, the number of inclusions having the above-limited size is counted, the number was converted to the number per unit cross-section, and the average values of numbers, which are measured at 20 visual field, was considered to be the representative value.

(3) Preliminary measurement: a typical inclusion was sampled, an electron probe micro-analysis (EPMA) was carried out, and an inclusion was specified. The differentiation of inclusions was carried out using properties (form or color) in the optical microscopic photographs of the specified inclusion as basic information during the optical microscopic or scanning microscopic observation.

<Conditions for the Delayed Fracture Test>

The conditions for the delayed fracture test of Invention Rails and Comparative Rails described in Tables 1-3, 1-4 and 2-2 are as described below.

(1) Rail shape: 136 pound rail (67 kg/m)

(2) Delayed fracture test

Figure 6A:
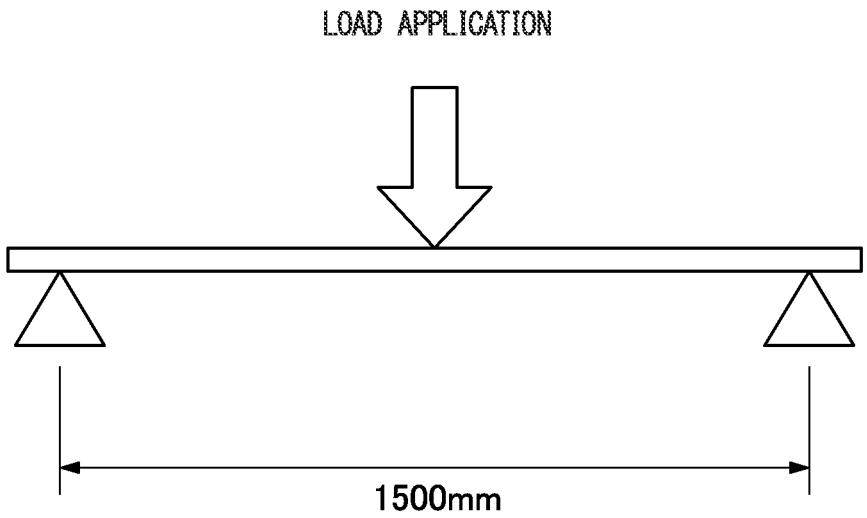
FIG. 6A is a pattern diagram illustrating a delayed fracture test method.

Test method: three-point bending (span length: 1.5 m, refer to FIG. 6A)

Figure 6B:
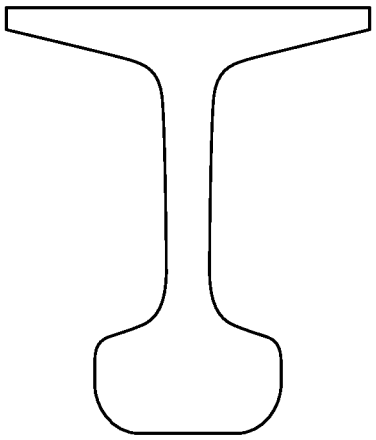
FIG. 6B is a view describing a weight bearing location in the delayed fracture test method of FIG. 6A.

Test position: a load was applied to the rail bottom section (tensile stress acts on the head section, refer to FIG. 6B).

Stress conditions: 200 MPa to 500 MPa (on the surface of the rail head section)

Stress application time: 500 hours (3) Limit stress value: the maximum value of the stress in a case in which the steel piece was not broken when a predetermined stress had been applied over 500 hours.

Details of Invention Rails and Comparative Rails described in Tables 1-1 to 1-4, 2-1 and 2-2 are as described below.

(1) Invention Rails (50 Pieces)

Reference signs (Steel Nos.) A1 to A50: rails having a chemical component value, a microstructure of the head surface section, hardness of the head surface section, and the number of MnS-based sulfide-based inclusions formed around an Al-based oxide as a nucleus and having a grain size in a range of 1 μm to 10 μm within the range of the present invention (2) Comparative Rails (22 Pieces)

Reference signs a1 to a7 (7 pieces): rails having C, Si, Mn and P contents or a microstructure of the head surface section outside the range of the present invention Reference signs a8 to a22 (15 pieces): rails having an Al or S content or the number of MnS-based sulfides formed around an Al-based oxide as a nucleus and having a grain size in a range of 1 μm to 10 μm outside the range of the present invention As described in Tables 1-1 to 1-4, 2-1 and 2-2, compared with Comparative Rails (reference signs a1 to a7), Invention Rails (reference signs A1 to A50) have C, Si, Mn and P contents of steel converged within the limited ranges, and therefore the formation of a pro-eutectoid ferrite structure, pro-eutectoid cementite structure or martensite structure is suppressed, and it is possible to control the head surface section to include a pearlite structure or a bainite structure. Furthermore, it is possible to improve the delayed fracture resistance by controlling the number of MnS-based sulfides formed around an Al-based oxide as a nucleus and having a grain size in a range of 1 μm to 10 μm, and suppressing the embrittlement of the structure.

Figure 4:
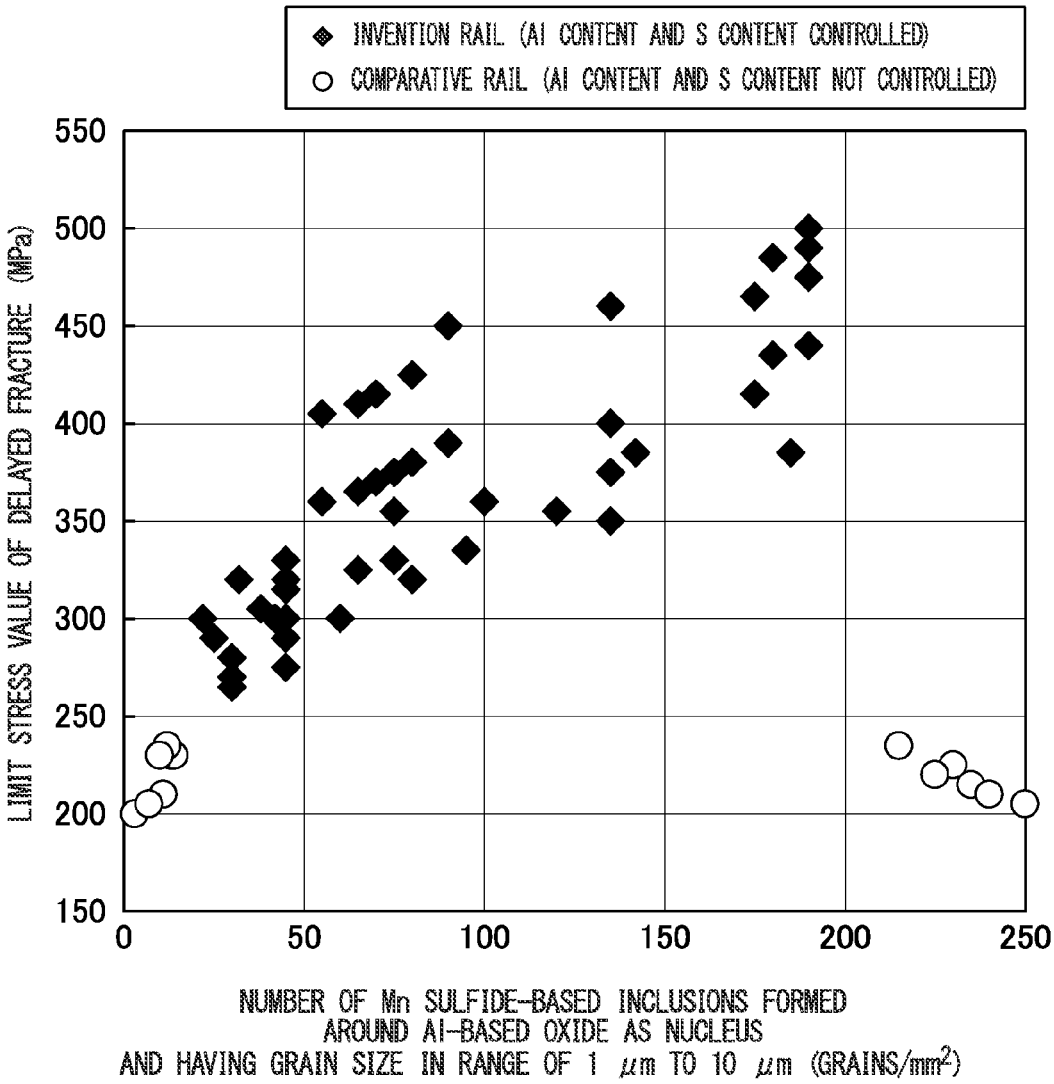
FIG. 4 is a view illustrating a relationship between the numbers of fine (grain size in a range of 1 μm to 10 μm) MnS-based sulfides formed around an Al-based oxide as a nucleus and the threshold stress values of delayed fracture in Invention Rails (reference signs A1 to A50) and Comparative Rails (reference signs a7 to a22) described in Tables 1-1 to 2-2.

In addition, as described in Tables 1-1 to 1-4, 2-1 and 2-2 and furthermore illustrated in FIG. 4, compared with Comparative Rails (reference signs a8 to a22), Invention Rails (reference signs A1 to A50) have Al and S contents of steel converged within the limited range in addition to the C, Si, Mn and P contents, it is possible to suppress the number of MnS-based sulfides formed around an Al-based oxide as a nucleus and having a grain size in a range of 1 μm to 10 μm and to improve the delayed fracture resistance.

Figure 5:
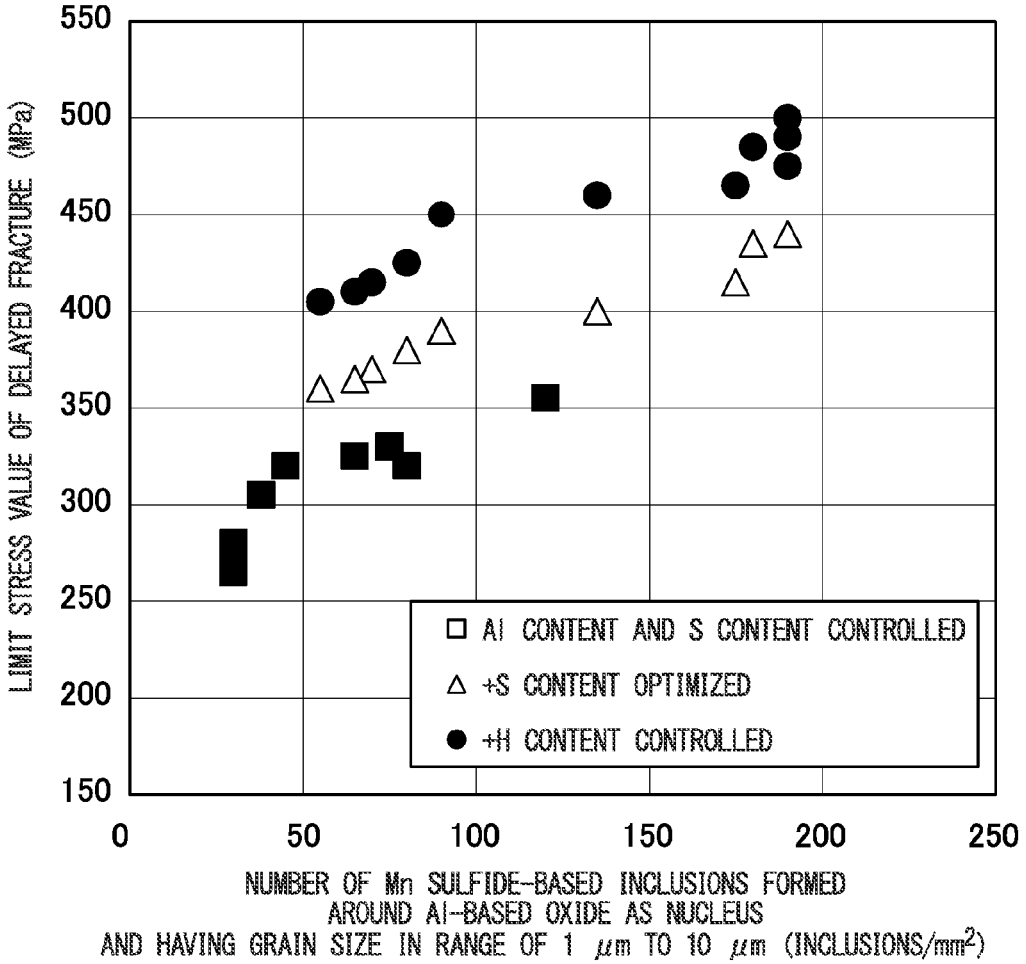
FIG. 5 is a view illustrating the numbers of fine (grain size in a range of 1 μm to 10 μm) MnS-based sulfides formed around an Al-based oxide as a nucleus and the threshold stress values of delayed fracture in Invention Rails (reference signs A14 to A16, A17 to A19, A22 to A24, A28 to A30, A32 to A34, A35 to A37, A38 to A40, A41 to A45 and A47 to A49) described in Tables 1-1 to 1-4 using a relationship between the control of an S content, the optimization of the S content and the control of an H content.

In addition, as described in Tables 1-1 to 1-4, 2-1 and 2-2 and furthermore illustrated in FIG. 5, when Invention Rails (reference signs A14 to A16, A17 to A19, A22 to A24, A28 to A30, A32 to A34, A35 to A37, A38 to A40, A41 to A45 and A47 to A49) are compared from the viewpoint of the S content and the H content, it is possible to further improve the delayed fracture resistance with the same number of MnS-based sulfides formed around an Al-based oxide as a nucleus by controlling the S content so as to suppress the number of MnS-based sulfides formed around an Al-based oxide as a nucleus and having a grain size in a range of 1 μm to 10 μm, and furthermore, by optimizing the S content and controlling the H content.

INDUSTRIAL APPLICABILITY

According to the present invention, it becomes possible to improve the delayed fracture resistance of a rail used for freight railways that transport resources and to significantly improve the service life by controlling the steel components and structure of the rail, and by controlling the form or number of MnS-based sulfides formed around an Al-based oxide in steel as a nucleus.

BRIEF DESCRIPTION OF THE REFERENCE SYMBOLS

1: HEAD TOP SECTION
2: HEAD CORNER SECTION
3: RAIL HEAD SECTION
**3*a***: HEAD SURFACE SECTION(RANGE FROM THE SURFACES OF HEAD CORNER SECTIONS AND HEAD TOP SECTION AS STARTING POINT TO A DEPTH OF 20 mm, HATCHED SECTION)

The invention claimed is:

1. A rail comprising, by mass %:
C: 0.70% to 1.20%;
Si: 0.05% to 2.00%;
Mn: 0.10% to 2.00%;
P: 0.0200% or less;
S: more than 0.0100% to 0.0250%;
Al: 0.0020% to 0.0100%, and
a balance consisting of Fe and impurities,
wherein 95% or more of a structure in a head surface section, which is a range from surfaces of head corner sections and a head top section of the rail as a starting point to a depth of 20 mm, is a pearlite or a bainite structure and
the structure contains 20 to 200 MnS-based sulfides formed around an Al-based oxide as a nucleus and having a grain size in a range of 1 μm to 10 μm per square millimeter of an area to be inspected on a horizontal cross section of the rail.

2. The rail according to claim 1,
wherein an S content is 0.0130% to 0.0200% by mass %.

3. The rail according to claim 2,
wherein an H content is 2.0 ppm or less.

4. The rail according to claim 1, further comprising, by mass %, one or more of:
Ca: 0.0005% to 0.0200%;
REM: 0.0005% to 0.0500%;
Cr: 0.01% to 2.00%;
Mo: 0.01% to 0.50%;
Co: 0.01% to 1.00%;
B: 0.0001% to 0.0050%;
Cu: 0.01% to 1.00%;
Ni: 0.01% to 1.00%;
V: 0.005% to 0.50%;
Nb: 0.001% to 0.050%;
Ti: 0.0050% to 0.0500%;
Zr: 0.0001% to 0.0200%;
N: 0.0060% to 0.0200%.

5. The rail according to claim 2, further comprising, by mass %, one or more of:
Ca: 0.0005% to 0.0200%;
REM: 0.0005% to 0.0500%;
Cr: 0.01% to 2.00%;
Mo: 0.01% to 0.50%;
Co: 0.01% to 1.00%;
B: 0.0001% to 0.0050%;
Cu: 0.01% to 1.00%;
Ni: 0.01% to 1.00%;
V: 0.005% to 0.50%;
Nb: 0.001% to 0.050%;
Ti: 0.0050% to 0.0500%;

Zr: 0.0001% to 0.0200%;
N: 0.0060% to 0.0200%.

6. The rail according to claim 3, further comprising, by mass %, one or more of:

Ca: 0.0005% to 0.0200%;
REM: 0.0005% to 0.0500%;
Cr: 0.01% to 2.00%;
Mo: 0.01% to 0.50%;
Co: 0.01% to 1.00%;
B: 0.0001% to 0.0050%;
Cu: 0.01% to 1.00%;
Ni: 0.01% to 1.00%;
V: 0.005% to 0.50%;
Nb: 0.001% to 0.050%;
Ti: 0.0050% to 0.0500%;
Zr: 0.0001% to 0.0200%;
N: 0.0060% to 0.0200%.

* * * * *